US009211579B2

(12) United States Patent
Tanaka et al.

(10) Patent No.: US 9,211,579 B2
(45) Date of Patent: Dec. 15, 2015

(54) METHOD OF PRODUCING L-SHAPED PRODUCT

(75) Inventors: Yasuharu Tanaka, Tokyo (JP); Takashi Miyagi, Tokyo (JP); Misao Ogawa, Tokyo (JP); Shigeru Uchiyama, Tokyo (JP); Takatoshi Sasahara, Hamatsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 242 days.

(21) Appl. No.: 13/989,095

(22) PCT Filed: Nov. 24, 2011

(86) PCT No.: PCT/JP2011/077073

§ 371 (c)(1),
(2), (4) Date: May 23, 2013

(87) PCT Pub. No.: WO2012/070623

PCT Pub. Date: May 31, 2012

(65) Prior Publication Data

US 2013/0239645 A1 Sep. 19, 2013

(30) Foreign Application Priority Data

Nov. 24, 2010 (JP) ..... 2010-260782

(51) Int. Cl.
*B21D 22/02* (2006.01)
*B21D 22/26* (2006.01)
*B21D 53/88* (2006.01)

(52) U.S. Cl.
CPC ..... *B21D 22/02* (2013.01); *B21D 22/26* (2013.01); *B21D 53/88* (2013.01)

(58) Field of Classification Search
CPC ..... B21D 22/20; B21D 22/22; B21D 22/26; B21D 24/00; B21D 24/005; B21D 24/04; B21D 22/02; B21D 53/88
USPC ..... 72/347, 348, 381, 383
See application file for complete search history.

(56) References Cited

U.S. PATENT DOCUMENTS 4,309,888 A * 1/1982 Miller et al. ..... 72/334
4,359,023 A * 11/1982 Persson ..... 123/195 C (Continued)

FOREIGN PATENT DOCUMENTS

JP 56-6731 A * 1/1981 ..... B21D 5/01
JP 59-61530 A * 4/1984 ..... B21D 22/26

(Continued)

OTHER PUBLICATIONS

International Search Report dated Feb. 21, 2012, issued in corresponding PCT Application No. PCT/JP2011/077073.

*Primary Examiner* — Edward Tolan
(74) *Attorney, Agent, or Firm* — Kenyon & Kenyon LLP

(57) ABSTRACT

A method of producing an L-shaped product (10) which includes an L-shaped flat top wall (12), an inside wall (14) extending and connected along an inside edge (12*c*) of the top wall, and an outside wall (16) extending and connected along an outside edge (12*d*) of the top wall, each of the inside and outside walls being terminated by flange (18, 20) substantially parallel to the top wall, is disclosed. The method comprises the steps of: providing sheet metal material; providing a drawing die assembly; and stamping the sheet metal material by the drawing die assembly to produce an intermediate product. The method further comprises the steps of: providing a bending die assembly; and stamping the intermediate product by the bending die assembly to produce an L-shaped product completed.

11 Claims, 21 Drawing Sheets

(56) References Cited

U.S. PATENT DOCUMENTS

| | | | | |
|---|---|---|---|---|
| 5,644,943 | A * | 7/1997 | Lanz | 72/348 |
| 7,596,980 | B2 * | 10/2009 | Kimura et al. | 72/348 |
| 2003/0061852 | A1 | 4/2003 | Yamano et al. | |
| 2004/0244458 | A1 | 12/2004 | Yamano et al. | |
| 2005/0262917 | A1 | 12/2005 | Osumi et al. | |
| 2012/0017744 | A1 * | 1/2012 | Nilsson | 83/861 |

FOREIGN PATENT DOCUMENTS

| | | | | |
|---|---|---|---|---|
| JP | 64-66024 | A * | 3/1989 | B21D 24/04 |
| JP | 5-76951 | A * | 3/1993 | B21D 22/20 |
| JP | 6-31351 | A * | 2/1994 | B21D 24/00 |
| JP | 8-66730 | | 3/1996 | |
| JP | 2003-103306 | | 4/2003 | |
| JP | 2004-154859 | | 6/2004 | |
| JP | 2006-015404 | | 1/2006 | |
| JP | 2007-111725 | | 5/2007 | |
| JP | 2008-307557 | | 12/2008 | |
| JP | 2009-241109 | | 10/2009 | |
| JP | 2009-255116 | | 11/2009 | |
| JP | 2010-120061 | | 6/2010 | |
| WO | 2011/145679 | | 11/2011 | |

* cited by examiner

METHOD OF PRODUCING L-SHAPED PRODUCT

This application is a national stage application of International Application No. PCT/JP2011/077073, filed Nov. 24, 2011, which claims priority to Japanese Application No. 2010-260782, filed Nov. 24, 2010, the content of which is incorporated by reference in its entirety.

FIELD OF THE INVENTION

The present invention relates to a method of producing an L-shaped product, and in particular to a method of producing an L-shaped member, which has a hat-shaped cross section, from a blank sheet of metal. In particular, the L-shaped member is used for a lower front pillar of an automobile having a monocoque body.

BACKGROUND ART

A frame structure of an automobile having a monocoque body is formed by joining a plurality of frame parts, produced by stamping sheet metal. A reinforcement of a lower front pillar, joined to the frame members such as an outer reinforcement of a side sill, comprises an L-shaped member having an L-shaped flat top wall, side walls extending along the edges of the top wall and flanges connected to the side wall. When such an L-shaped product is produced by stamping a blank sheet of metal, there are problems such as generation of wrinkles in the top wall and cracks in an inside flange of the L-shaped product.

If such an L-shaped product is formed by a drawing process, generation of wrinkles can be avoided. In drawing, however, it is necessary to provide a blank with a relatively large margin, which results in lower yield rate and higher production cost.

Further, for drawing processes, it is necessary to use a blank of relatively high extensibility, whereby a blank for drawing is made of a relatively low-strength material. Thus, in order to increase the collision performance of automobiles, a relatively thick blank is required, which results in an increase in the weight of the frame structure, and thus higher material cost.

Various bending methods have been proposed for producing a component having uniform cross section such as simple hat-shaped cross section, or Z-shaped cross section as described in Patent Publications 1-4. However, Patent Publications 1-4 do not disclose a method of producing a more complicated L-shaped member described above.

PRIOR ART DOCUMENTS

Patent Publication

Patent Publication 1: Japanese Unexamined Patent Application Publication No. 2003-103306

Patent Publication 2: Japanese Unexamined Patent Application Publication No. 2004-154859

Patent Publication 3: Japanese Unexamined Patent Application Publication No. 2006-015404

Patent Publication 4: Japanese Unexamined Patent Application Publication No. 2008-307557

SUMMARY OF THE INVENTION

Problem to be solved by the Invention

Thus, the present invention is directed to solve the above-described problem of the prior art, and therefore, the object of the present invention is to provide a method of producing an L-shaped product by stamping a blank having a relatively small margin, as compared with conventional drawing process, without generation of cracks and/or wrinkles. Another object of the present invention is to provide a method of producing a satisfactory L-shaped product by using a blank made of a high tensile strength steel sheet having lower extensibility as well as a steel sheet having high extensibility and low strength.

Means for solving the Problem

In order to obtain the above-described object, according to the present invention, there is provided a method of producing an L-shaped product which includes an L-shaped flat top wall having first and second legs connected to each other so as to define inside and outside edges, an inside wall extending along and connected to the inside edge of the top wall and forming a first angle relative to the top wall, and an outside wall extending along and connected to the outside edge of the top wall and forming a second angle relative to the top wall, each of the inside and outside walls being terminated by a flange substantially parallel to the top wall, the method comprising the steps of:

providing sheet metal material; providing a drawing die assembly; and stamping the sheet metal material with the drawing die assembly to produce an intermediate product which includes an L-shaped flat top wall having first and second legs corresponding to the first and second legs of the L-shaped flat top wall of the L-shaped product, and inside and outside walls corresponding to the inside and outside walls of the completed L-shaped product, and flanges corresponding to the flanges of the completed L-shaped product;

wherein the intermediate product includes a first region adjacent to a free end of the first leg and an opposite second region adjacent to the second leg, and wherein, in the first region, the angle between each of the inside and outside walls relative to the top wall of the intermediate product substantially coincide with the first and second angles of the completed L-shaped product, and wherein, in the second region, the angle between each of the inside and outside walls relative to the top wall gradually increases toward the second leg;

the method further comprising the steps of:

providing a bending die assembly; stamping the intermediate product by the bending die assembly to produce the completed L-shaped product.

Effect of the Invention

According to the present invention, an intermediate product is produced by stamping a blank sheet of metal by means of a drawing die assembly, and an L-shaped product is produced by further stamping the intermediate product by means of a bending die assembly. Thus, in the stamping process by means of the bending die assembly, the second leg is bent toward the inside curved portion. The region of the top wall where material is usually accumulated in excess is drawn by the bending process so that material flows out and generation of wrinkles can be suppressed. On the other hand, the inside flange adjacent to the inside curved portion where, in an ordinary drawing process, the wall thickness is reduced and may result in cracks forming, and therefore is compressed by the bending deformation so that reduction of the wall thickness is suppressed and generation of wrinkles or cracks can be avoided.

In this case, a relatively large margin which has been required in ordinary drawing, does not need to be provided in a blank, so that it is possible to reduce the size of a blank. A product can be formed not only from a steel sheet having high extensibility and relatively low strength but also from high tensile strength steel material which has been difficult to be shaped in prior art, so that strength of an L-shaped product can be increased and thickness of a blank can be reduced, which contributes to weight reduction of the frame structure of an automobile.

In the case where an outside curved portion extending in the shape of circular arc is provided in the outside wall opposite to the inside curved portion of an L-shaped product, generation of wrinkles in the top wall can be avoided by bulging the side edge between the outside wall and the top wall in the shape of circular arc upward from the top wall in the outside curved portion.

EMBODIMENT FOR CARRYING OUT THE INVENTION

Preferred embodiments of the present invention will be described below.

Figure 1:
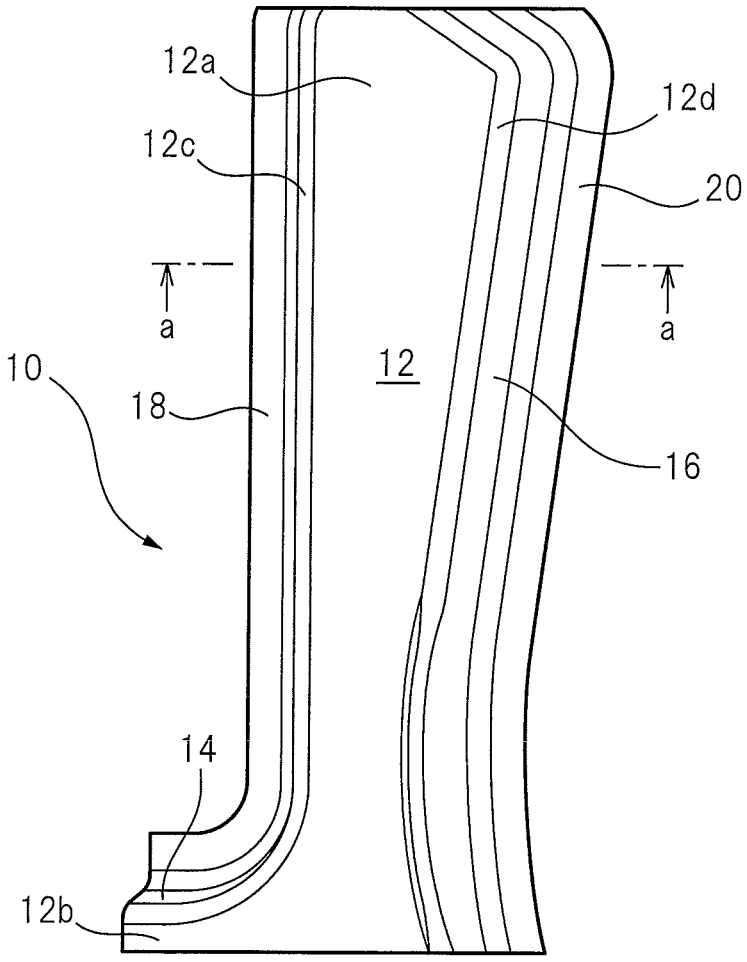
FIG. 1 is a perspective view showing an L-shaped product to be produced.
Figure 1A:
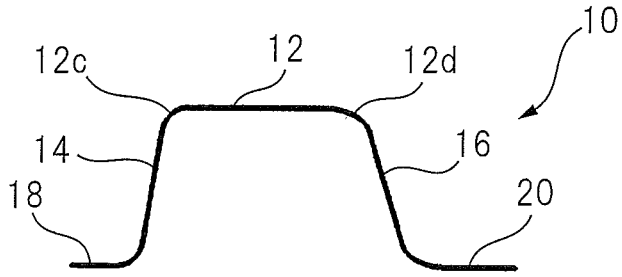
FIG. 1A is a section of the L-shaped product along line a-a in FIG. 1.

Referring to FIGS. 1 and 1A, an L-shaped product 10, with a hat-shaped cross section is produced by a stamping process according to the present invention. The L-shaped production 10 comprises a top wall 12 substantially in the form of L having first and second legs 12*a* and 12*b* connected to each other. The L-shaped product 10 further comprises an inside wall 14 extending along an inside edge 12*c* of the top wall 12 and forming a first angle $\alpha_1$ relative to the top wall 12, and an outside wall 16 extending along an outside edge 12*d* of the top wall 12 and forming a second angle $\alpha_2$ relative to the top wall 12. Each of the inside and outside walls 14 and 16 is terminated by inside and outside flanges 18 and 20 extending substantially parallel to the top wall 12. The first and second angles $\alpha_1$ and $\alpha_2$ are in particular within the range of 90 to 115°.

Further, the L-shaped product 10 defines an inside curved portion 22 and an outside curved portion 24 between the first and second legs 12*a* and 12*b*. The L-shaped product can be used in a frame structure of an automobile having a monocoque body as a lower portion of a front pillar, extending from the lower edge of a wind shield to a side sill. The first leg 12*a* is adapted to be connected to an upper portion of the front pillar which extends along a side edge of the wind shield. The second leg 12*b* is adapted to be connected to the side sill. The outside curved portion 24 extends substantially along a circular arc so as to form a part of a wheel house of a front wheel.

Figure 2:
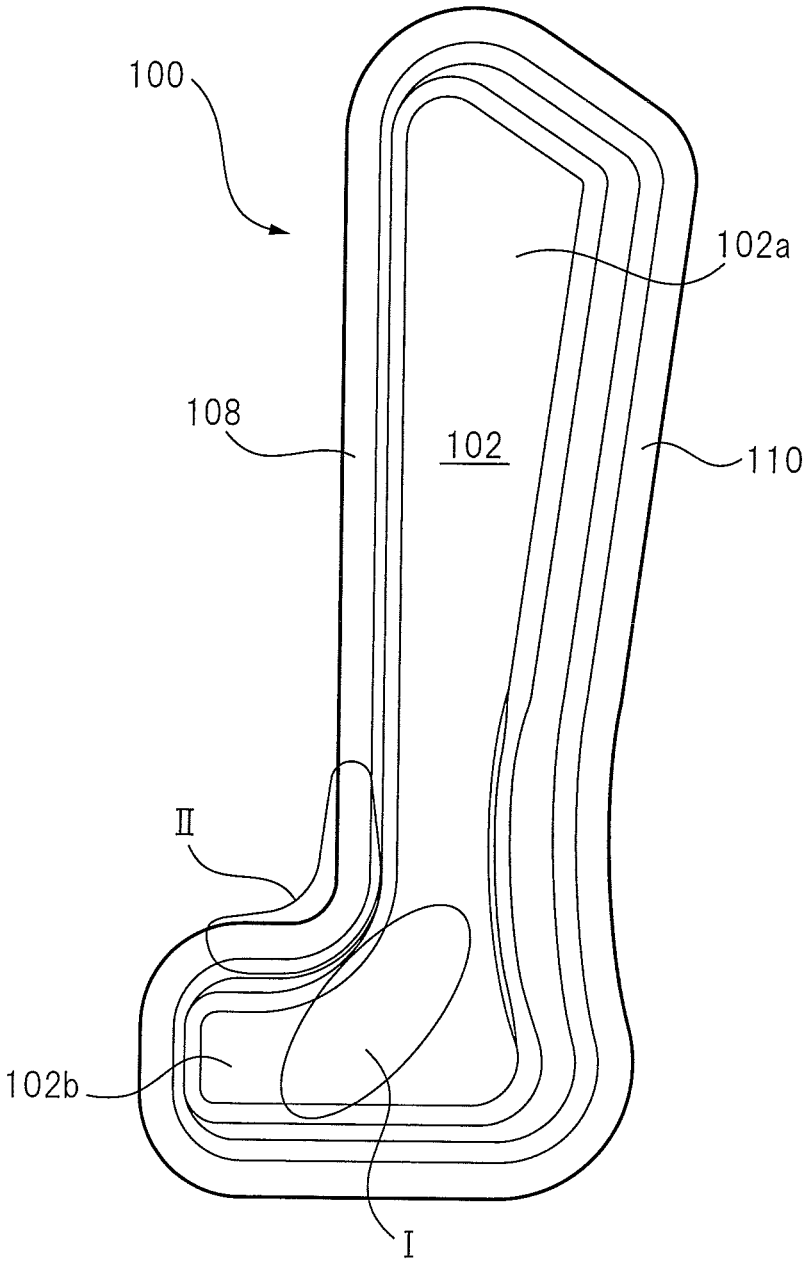
FIG. 2 is a perspective view showing an L-shaped panel drawn.

Conventionally, in order to produce an L-shaped product such as shown in FIG. 1, a blank, made of sheet metal and having a relatively large margin, is provided. By drawing the blank, a drawn panel 100 as shown in FIG. 2 is formed, then excess portions are removed from the drawn panel 100. In this method, wall thickness becomes excessive in a portion I in the top wall 102 between first and second legs 102*a* and 102*b* of the drawn panel, whereby wrinkles are generated, while in a curved portion II of the inside flange 108 between the first and second legs 102*a* and 102*b*, the amount of material becomes insufficient, whereby cracks may occur in the flange 108. In order to prevent generation of wrinkles and cracks, a steel sheet having high extensibility and relatively low strength is used. The steel sheet is extended by providing a relatively large margin in a portion to be formed into the second leg of the L-shaped product so that the steel sheet is sufficiently clamped in order to prevent material inflow during drawing process, and thus generation of wrinkles in the top wall is prevented.

Referring to FIG. 2, in order to produce an L-shaped product 10, according to the present invention, firstly, a drawing die assembly 30 is provided. The drawing die assembly 30 comprises a drawing die 32, a holder 34 disposed to face the drawing die 32 and a punch 36. The drawing die 32 has a recess 32*a* having a shape corresponding to the shapes of a top wall 52 and inside and outside walls 54 and 56 of an intermediate product 50. The drawing die has further a flank 32*b* defining a flat surface extending along the peripheral edge of the recess 32*a*. The holder 34 has a flat clamping surface 34*a* facing the flank 32*b* of the drawing die 32. In particular, the clamping surface 34*a* of the holder 34 has a substantially U-shaped form with one open end so as not to clamp a portion of the blank 26 corresponding to the edge 52*e* adjacent to the second leg 52*b* opposite to the first leg 52*a* in the intermediate product 50. The punch 36 has an outer shape 36*a* corresponding to the shape of the recess 32*a* of the drawing die 32. A blank 26 of a flat sheet metal having a developed shape of completed product is positioned between the drawing die 32 and the holder 34. The blank 26 is clamped with the flank 32*b* of the drawing die 32 and the clamping surface 34*a* of the holder 34 along the peripheral edge of the recess 32*a* of the drawing die 32. Then, the punch 36 is pressed into the recess 32*a* of the drawing die 32 to produce an intermediate product 50.

Figure 6:
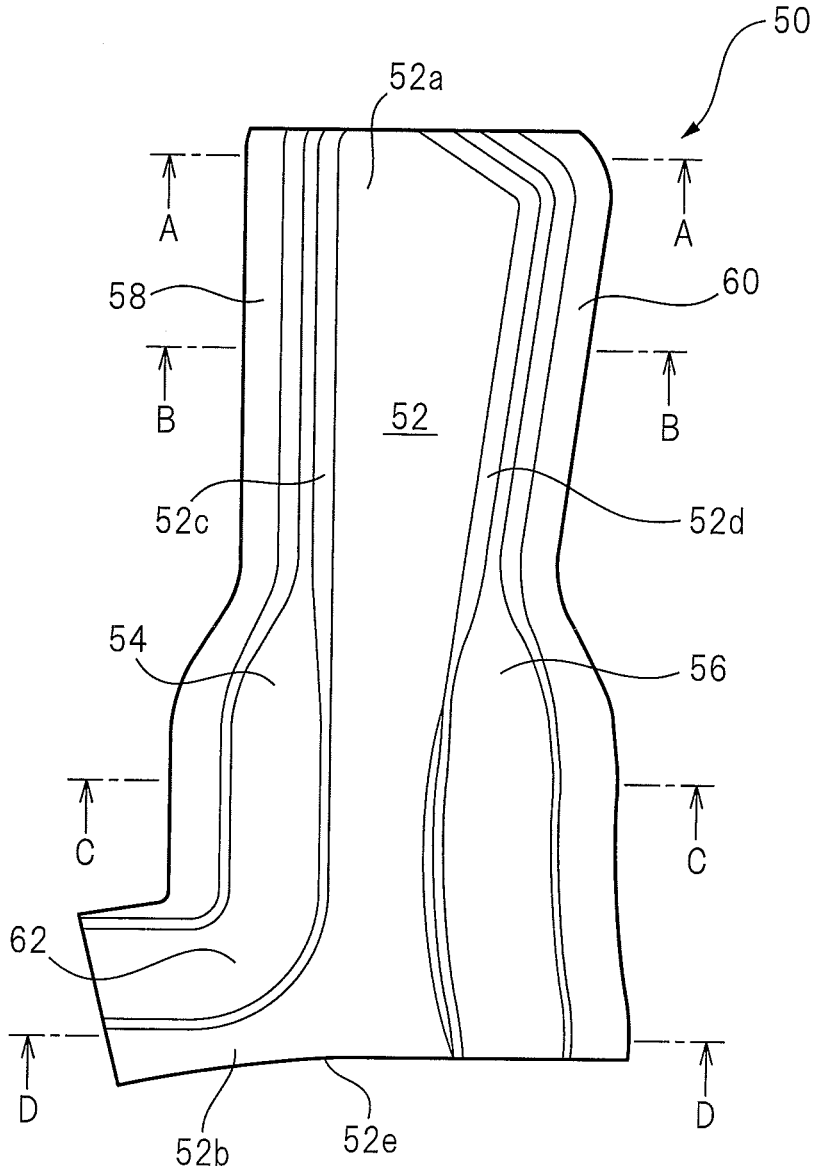
FIG. 6 is a plan view showing an intermediate product.

Referring to FIG. 6, the intermediate product 50 comprises a substantially L-shaped flat top wall 52 having first and second legs 52*a* and 52*b*, respectively corresponding to the first and second legs 12*a* and 12*b* of the top wall 12 of the completed L-shaped product 10. The intermediate product 50 further comprises inside and outside walls 54 and 56 extending along inside and outside edges 52*c* and 52*d* of the top wall 52, and respectively corresponding to the inside and outside walls 14 and of the L-shaped product 10. The intermediate product further includes inside and outside flanges 58 and 60, respectively corresponding to the inside and outside flanges 18 and 20 of the L-shaped product 10.

Figure 6A:
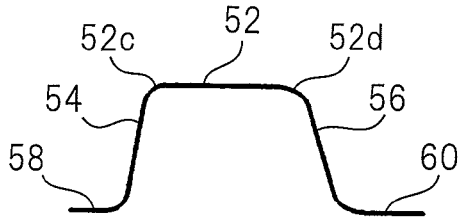
FIG. 6A is a section showing the intermediate product along line A-A in FIG. 6.
Figure 6B:
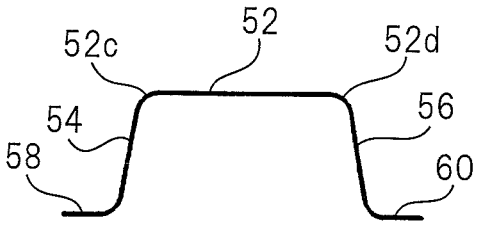
FIG. 6B is a section showing the intermediate product along line B-B in FIG. 6.
Figure 6C:
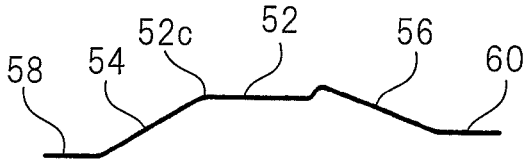
FIG. 6C is a section showing the intermediate product along line C-C in FIG. 6.
Figure 6D:
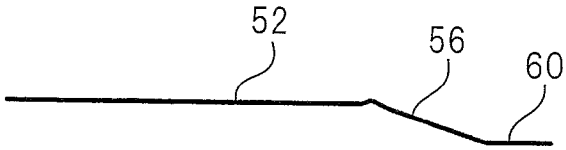
FIG. 6D is a section showing the intermediate product along line D-D in FIG. 6.

The intermediate product 50 includes a first region adjacent to the free end of the first leg 52*a* and a second region adjacent to the second leg 52*b*. In the first region, as shown in FIGS. 6A and 6B, which show the sections of the intermediate product 50 along lines A-A and B-B of FIG. 6, first angles $\beta_{2A}$ and $\beta_{2B}$ and second angles $\beta_{2A}$ and $\beta_{2B}$, formed by each of the inside and outside walls 54 and 56 relative to the top wall 52, are substantially equal to the first and second angles $\alpha_1$ and $\alpha_2$ formed by the inside and outside walls 14 and 16 relative to the top wall 12 of the completed L-shaped product 10, and are in the range of 90-115°. Thus, in the first region, the shape of the intermediate product 50 substantially coincides with the corresponding shape of the completed L-shaped product 10.

In the second region, as shown in FIG. 6, which is a section of the intermediate product 50 along line C-C of FIG. 6, first and second angles $\beta_{1C}$ and $\beta_{2C}$, formed by each of the inside and outside walls 54 and 56 relative to the top wall 52, are larger than the first and second angles $\alpha_1$ and $\alpha_2$ of the completed L-shaped product 10. The first and second angles gradually increase toward the second leg 52*b*. In particular, the first and second angles $\beta_{1C}$ and $\beta_{2C}$ of the intermediate product 50 in C-C section are in the range of 120-180°. Further, in the section along line D-D in FIG. 6, the first angle of the intermediate product 50 disappears, and thus, in this portion, that is, in the vicinity of the edge 52*e* adjacent to the second leg 52*b* of the intermediate product 50, the inside wall 54 extends substantially in the same plane as the top wall 52.

Figure 3:
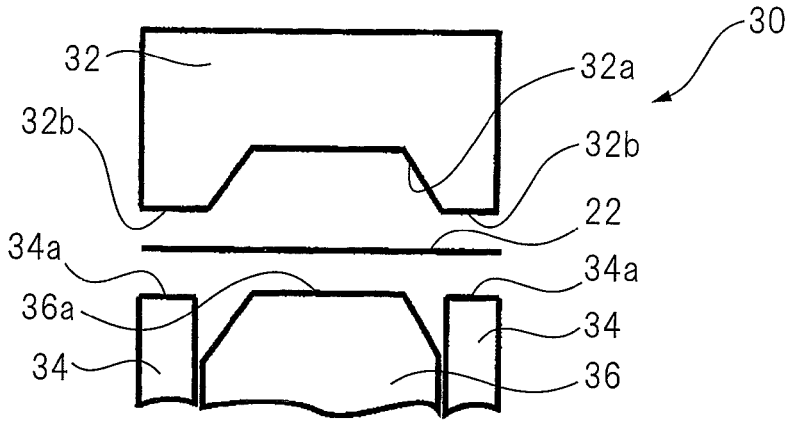
FIG. 3 is a section showing drawing process.
Figure 4:
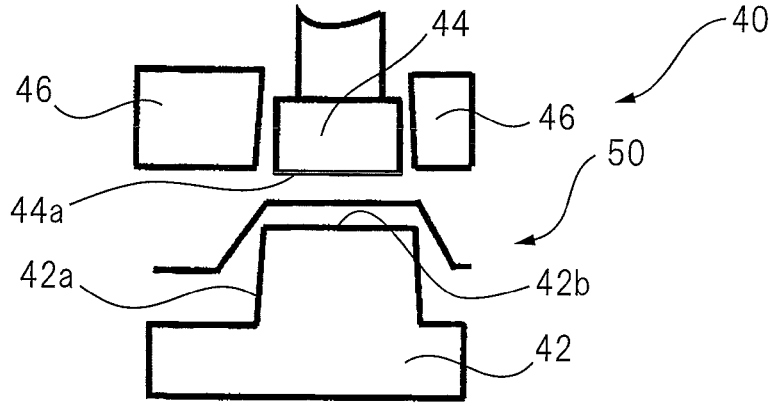
FIG. 4 is a section showing bending process at the time of start.
Figure 5:
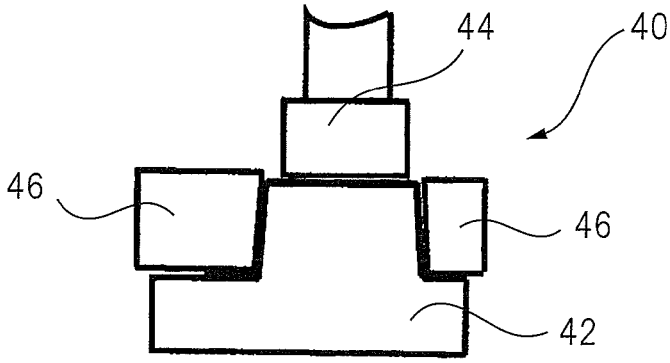
FIG. 5 is a section showing bending process.

In order to obtain the final completed L-shaped product 10 from the intermediate product 50 thus formed, a bending die assembly 40 is provided. Referring to FIGS. 3 and 4, the bending die assembly 40 comprises an anvil 42 having an exterior shape 42*a* corresponding to the shape of the completed L-shaped product 10, a pad 44 having an abutting surface 44*a* for clamping the top wall 52 of the intermediate product 50 in cooperation with the anvil 42 and a bending die 46 for pressing the intermediate product 50 to the anvil 42. The anvil 42 includes a flat top surface 42*b* facing the abutting surface 44*a* of the pad 44. The L-shaped top wall 52 of intermediate product 50 is disposed between the top surface 42*b* of the anvil 42 and the abutting surface 44*a* of the pad 44.

As described above, in the first region adjacent to the free end of the first leg 12*a* of the L-shaped product 10, the changes in its shape are relatively small, and thus, it can be formed into substantially same shape as the final shape by drawing. In contrast, in the second region, including the inside and outside curved portions 22 and 24, adjacent to the second leg 12*b*, the changes in the shape of the L-shaped product 10 is relatively large, and thus, wrinkles and cracks may occur. In the present embodiment described above, the intermediate product 50 is produced from a blank by a first drawing process. Then, the intermediate product 50, especially the second region, undergoes a second bending process, whereby the shape coincided with the final shape of the L-shaped product 10 is obtained.

Figure 7:
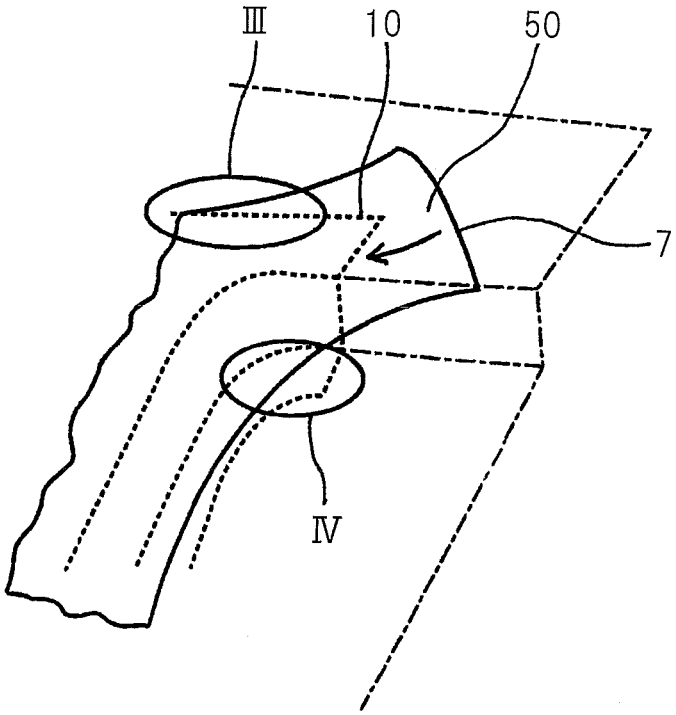
FIG. 7 is a view useful for explaining movement of blank material during bending process.
Figure 8:
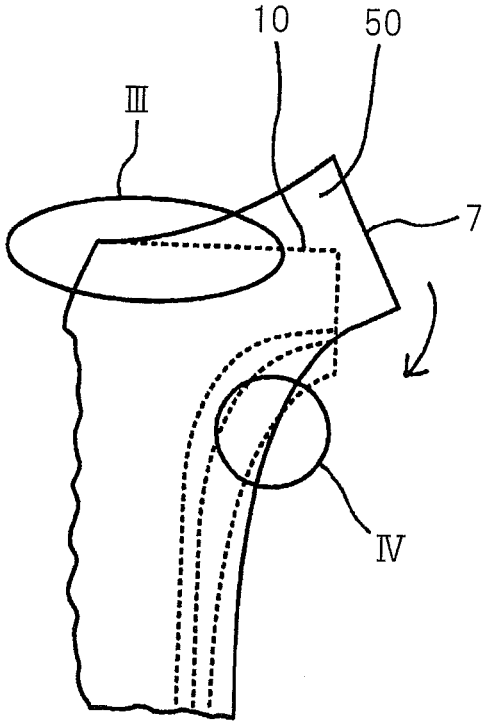
FIG. 8 is a view useful for explaining movement of blank material during bending process.

During the bending process, the intermediate product 50 is pressed to the anvil 42 by the bending die 46. In the inside curved portion 62 of the inside wall 54 of the intermediate product 50, material flows along the surface of the anvil, which surface corresponds to the inside curved portion 22 of the L-shaped product 10. Accordingly, in the inside flange 58, corresponding to the portion II of the inside flange 108 of the panel 100, the material flows into a portion IV (FIGS. 7 and 8) which extends from the inside curved portion 62 of the inside wall 54, whereby generation of crack in the portion IV is prevented. On the other hand, the material flows out of the portion III of the intermediate product (portion I of the top wall 102 of the panel 100), where wrinkles may occur due to an excess amount of material in prior art, whereby the generation of wrinkles is prevented.

Figure 13:
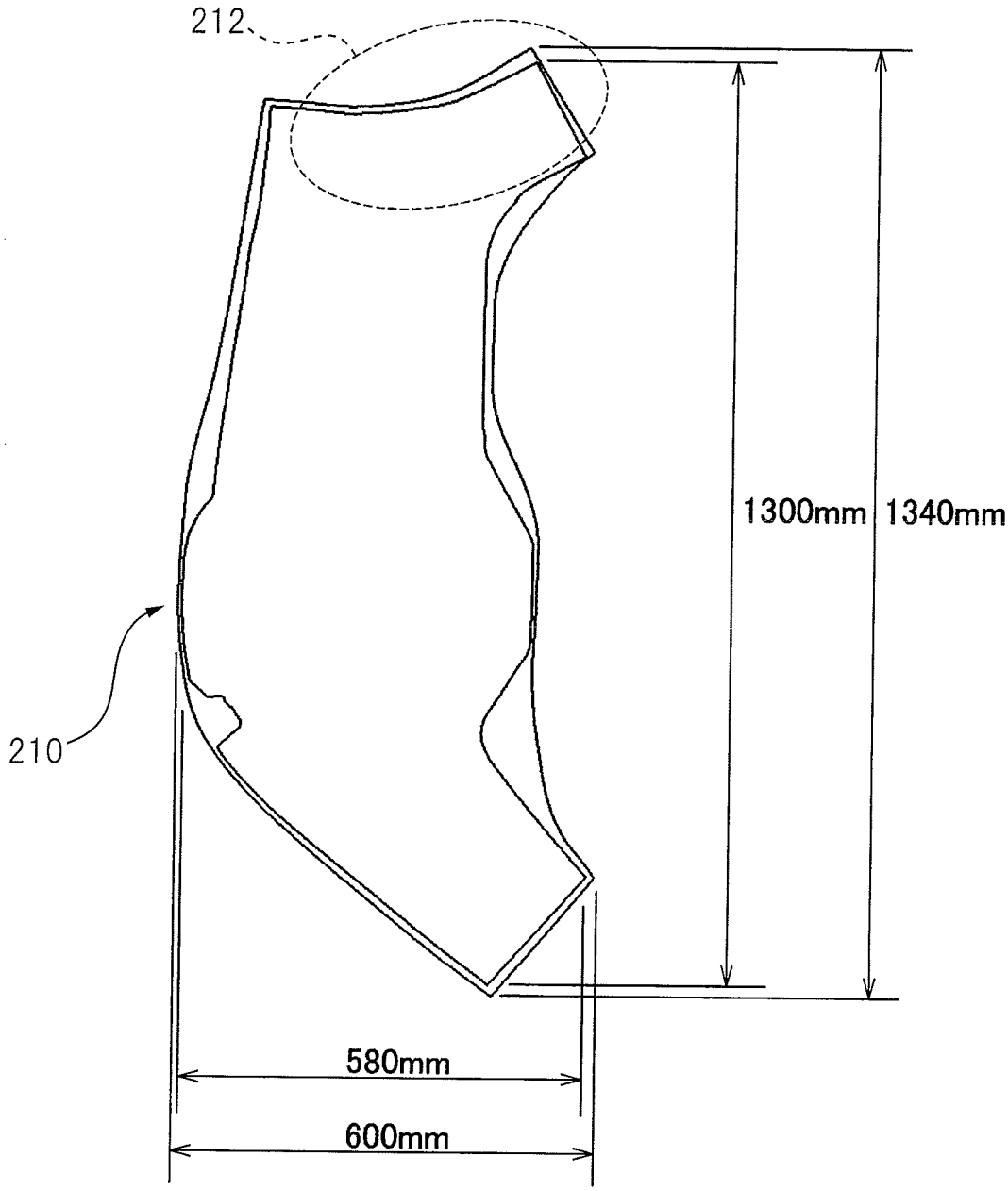
FIG. 13 is a plan view showing the blank in the embodiment of FIG. 12.

In this way, the material flows into the inside part from the free end of the lower part of the L-shaped member, while a portion K of the end of the lower part of L-shaped member is stretched, and is prevented from being thickened. For this purpose, the portion in the blank to be formed into the second leg 12*b* of the completed L-shaped product 10 is shaped into a curved protrusion, as shown in FIG. 13, so that the end of the lower part of the L-shaped member is tightly formed into the designed shape, whereby excessive material to be removed can be minimized or eliminated, and thus substantially contributing to improvement of yield rate. Regarding the curved protrusion in the end of the lower part of the L-shaped member before the stamping process, the curved protrusion may be defined by a constant curvature line or a combination of plural lines of various curvatures, an ellipsoidal line, a straight line, a combination of straight and curved lines or a wavy line, depending on the shape of the completed L-shaped member or the necessary margin for jointing with other parts. The amount of protrusion may also be suitably adjusted according to the shape of parts and extent of processing. In order to adjust the curvature or the amount of protrusion, a computer simulation may be advantageously used.

Due to the mode of deformation of the second leg of the intermediate product, described above, a large margin, as is usual in conventional shaping method, does not necessary have to be provided, and thus, the size of the blank can be reduced compared with the conventional shaping methods. Reduction in the wall thickness during the stamping process is reduced so that high tensile strength material, as well as a steel sheet having high extensibility and relatively low strength, can be used so as to achieve good stamping.

Figure 9A:
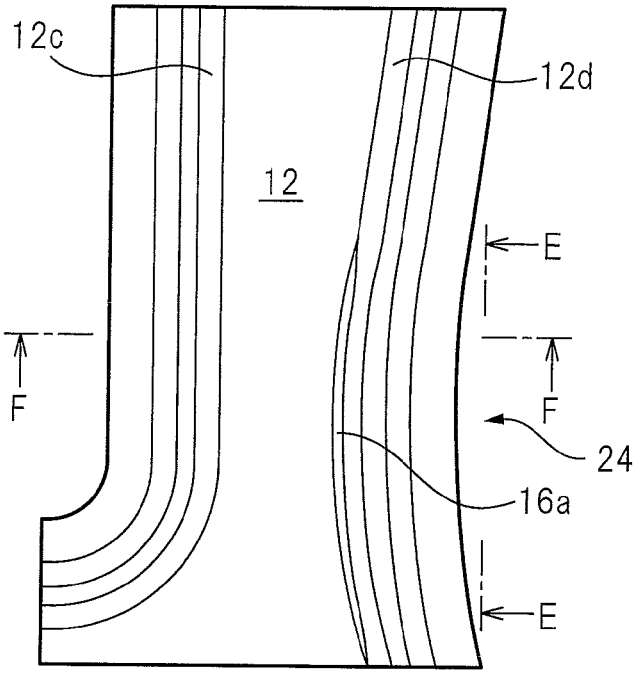
FIG. 9A is a plan view showing a portion of the L-shaped product after bending.
Figure 9B:
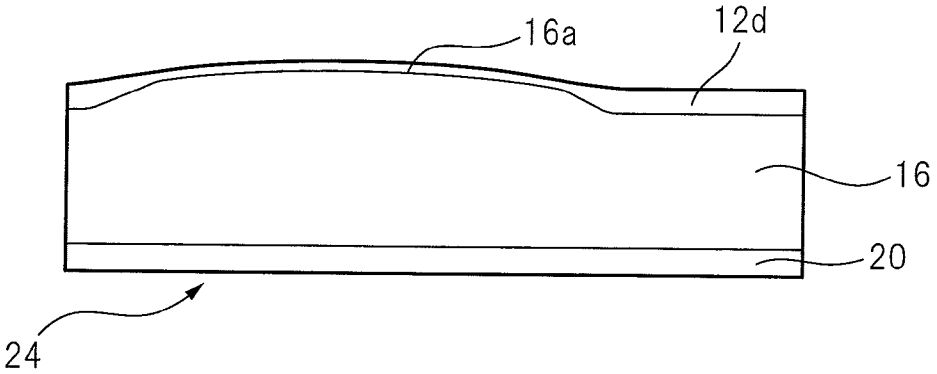
FIG. 9B is a partial side view showing the L-shaped product as seen in the direction of arrow E-E in FIG. 9A.
Figure 9C:
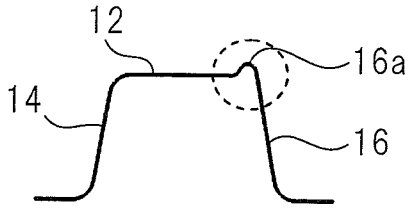
FIG. 9C is a section showing the L-shaped product along line F-F in FIG. 9A.

Regarding the outside curved portion 24 extending along a circular arc, if the outside edge 12*d* of the top wall 12 is simply bent to fit the outside curved portion 24, then the outside wall 16 is likely to be thickened, resulting in generation of wrinkles. Therefore, according to the present invention, in the outside curved portion 24, a protrusion 16*a* in the form of a circular arc extending upwardly from the top wall 12 as shown in FIG. 9B is provided in the outside edge 12*d* between the top wall 12 and the outside wall 16. In particular, difference between the arcuate profile of the outside curved portion 24, seeing in a plan view of the top wall 12 shown in the left side of FIG. 9A, and the arcuate profile of the upper end portion 9, seeing in side view as shown in FIG. 9, is set to within 10 mm. By providing the protrusion 16*a* in this way, excess material of the outside wall 16 can be absorbed, preventing the generation of wrinkles.

Figure 10:
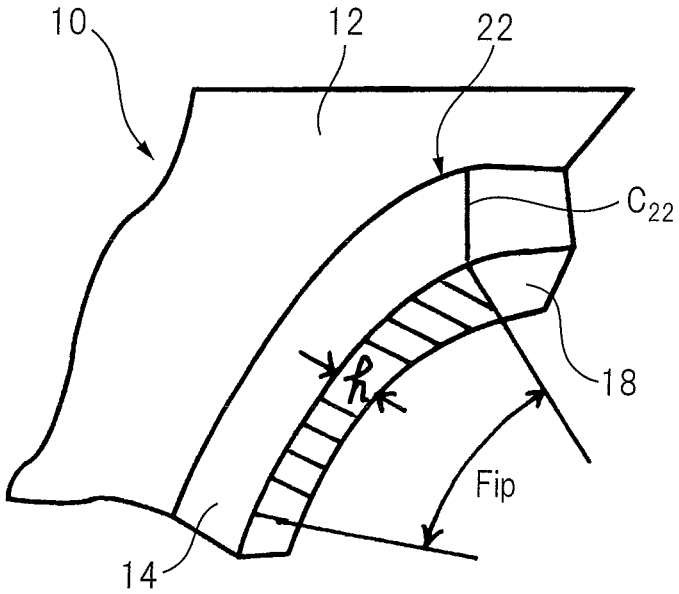
FIG. 10 is a perspective view showing an L-shaped member after bending process.
Figure 11:
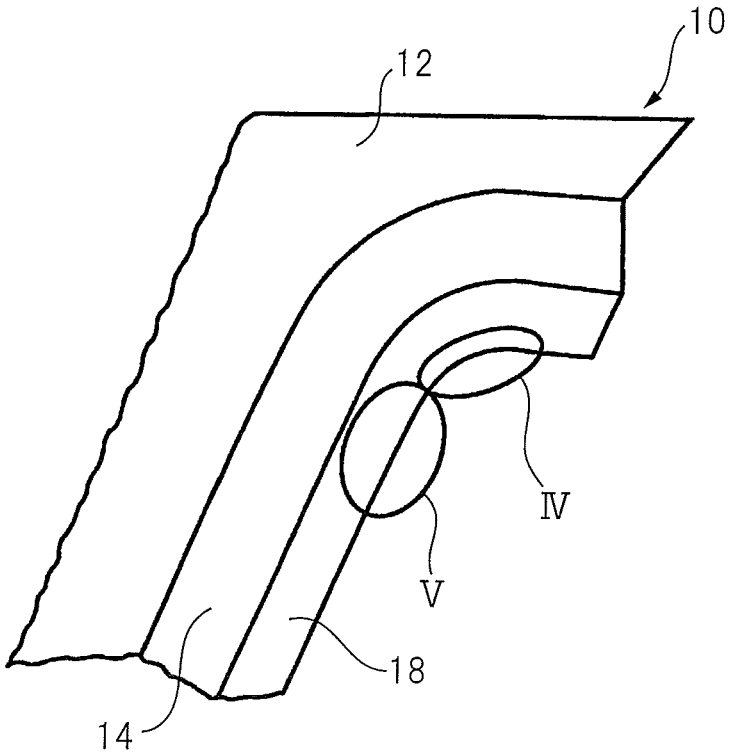
FIG. 11 is a perspective view showing an L-shaped member after bending process.

Further, for reasons described below, the width h of the inside flange 18 of the L-shaped product 10 are preferably in the range of 25-100 mm, in a predetermined area $F_{ip}$, in the present embodiment in the area $F_{ip}$ of 100 mm, from the center portion $C_{22}$ of the inside curved portion 22 of the bent L-shaped product toward the first leg 12*a*, as shown in FIG. 10. First, in bending process, when the intermediate product 50 is pressed to the anvil 42 by the bending die 46, the second leg 52*b* of the intermediate product 50 is pulled and bent toward the first leg 52*a*, as shown by arrow A in FIG. 8. At this point, the force that pulls the second leg 52*b* toward the first leg 52*a* is exerted to the portion in the predetermined area $F_{ip}$ of the inside flange 18 of the L-shaped product 10. In the case where the width h is equal to or less than 25 mm, the stress in the portion indicated by V in FIG. 11 becomes excessive, so that there is a problem that, in the end portion III adjacent to the second leg 52*b* of the top wall 52 of the intermediate product 50 (FIGS. 7 and 8), the material outflow becomes excessive and wall thickness decreases significantly and cracks may occur. In the case where the width h is equal to or more than 100 mm, compression in the portion IV adjacent to the inside curved portion 62 in the inside flange of the intermediate product 50 (FIG. 11) becomes excessive. Therefore, in the inside flange 18 of the completed L-shaped product 10, wrinkles may occur in the portion IV adjacent to the inside curved portion 22. By setting the width h to 25-100 mm, generation of wrinkles and excessive reduction in wall thickness can be avoided in the entire inside flange 18 including the portions IV and V of FIG. 11.

Further, in the inside curved portion 22 of the L-shaped product 10, the inside wall 14 has a radius of curvature of at least 5 mm. If, in the inside curved portion 22, the radius of curvature of the inside wall 14 is equal to or less than 5 mm, the curvature is too large. This results in a locally bulging deformation in the portion around the joint between the inside wall 14 and the inside flange 18, at a portion of the maximum curvature. Thus, cracks may occur. On the other hand, if the radius of curvature of the inside curved portion 22 of the inside wall 14 exceeds 300 mm, the second leg 12*b* of the L-shaped product 10 becomes too long, so that the distance for the second leg 12*b* of the L-shaped product 10 to be drawn into the inside curved portion 22 in bending process becomes large. Therefore, the bending die assembly 40 and the intermediate product 50 relatively slide to each other along a long distance, resulting in earlier wear of the bending die assembly 40. Thus, the radius of curvature of the inside curved portion 22 of the inside wall 14 is preferably in the range of 5-300 mm. Further, since, in the stamping process of the present invention, reduction of plate thickness of the blank 26 can be made small, a high tensile strength and low extensibility steel sheet, such as a steel sheet having tensile strength of 400 MPa or more to 1600 MPa or less can be used as the sheet metal forming the blank 26.

According to the method of the present invention, an L-shaped product 10 having an inside curved portion 22 and an outside curved portion 24 can be processed by stamping the blank 26 of sheet metal, which has a relatively small margin compared with sheet metal used for conventional drawing processes, without generating wrinkles or cracks.

EXAMPLE 1

Figure 12:
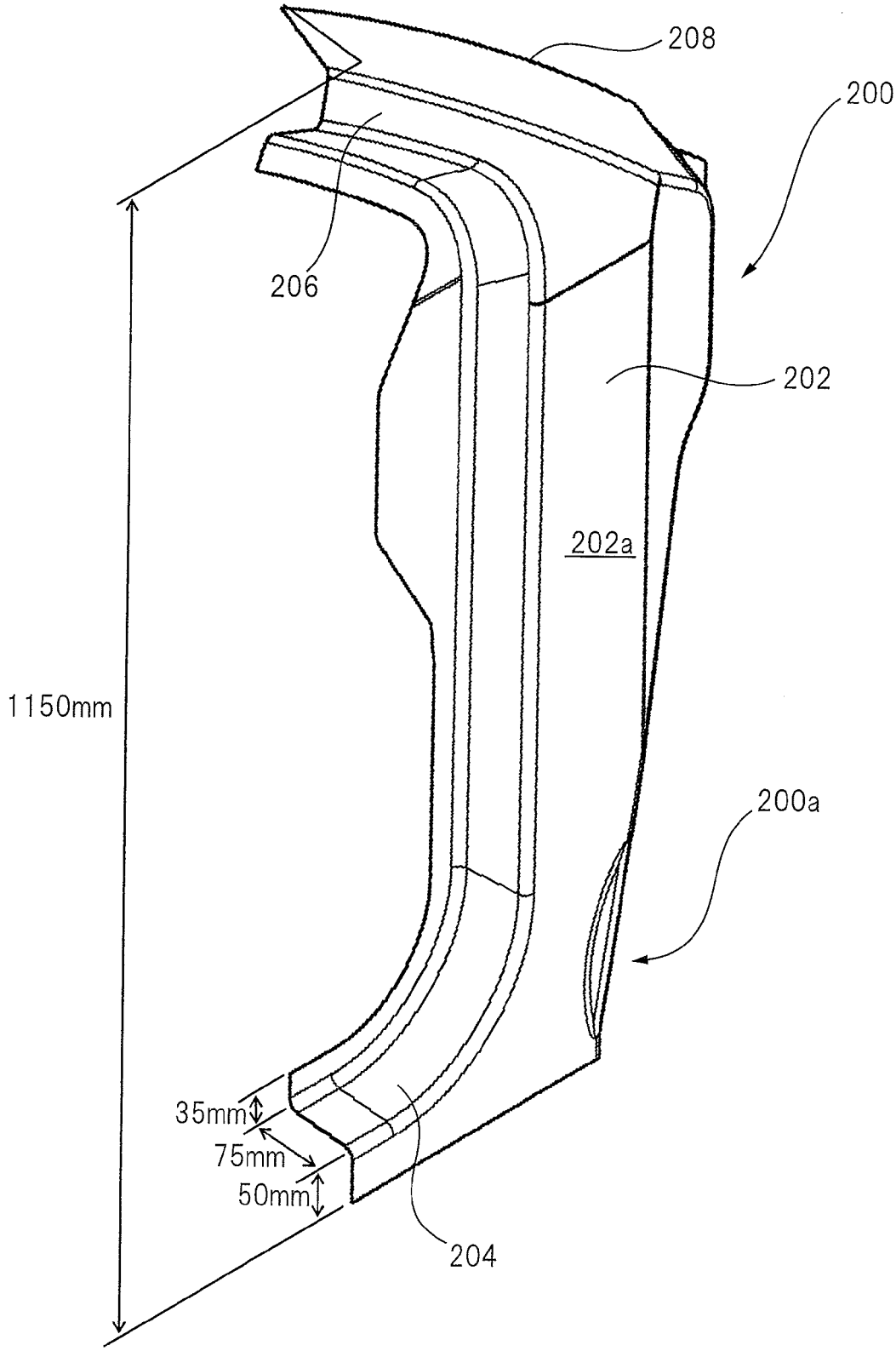
FIG. 12 is a perspective view of an L-shaped product in one embodiment.

FIG. 12 shows an example of L-shaped product produced by the method of producing an L-shaped product according to a preferred embodiment of the present invention described above.

In FIG. 12, the L-shaped product 200 provides a lower part of a front pillar extending from a lower edge of a wind shield to a side sill (not shown) in a frame structure of an automobile having a monocoque body. The L-shaped product 200 includes a portion of the front pillar upper portion 206 extending along the wind shield side edge 208, a first leg 202 adapted to be connected to the front pillar upper part 206, and a second leg 204 adapted to be connected to the side sill. The outside curved portion 200*a* extends substantially along a circular arc and forms a part of a wheel house (not shown) of a front wheel.

Figure 14:
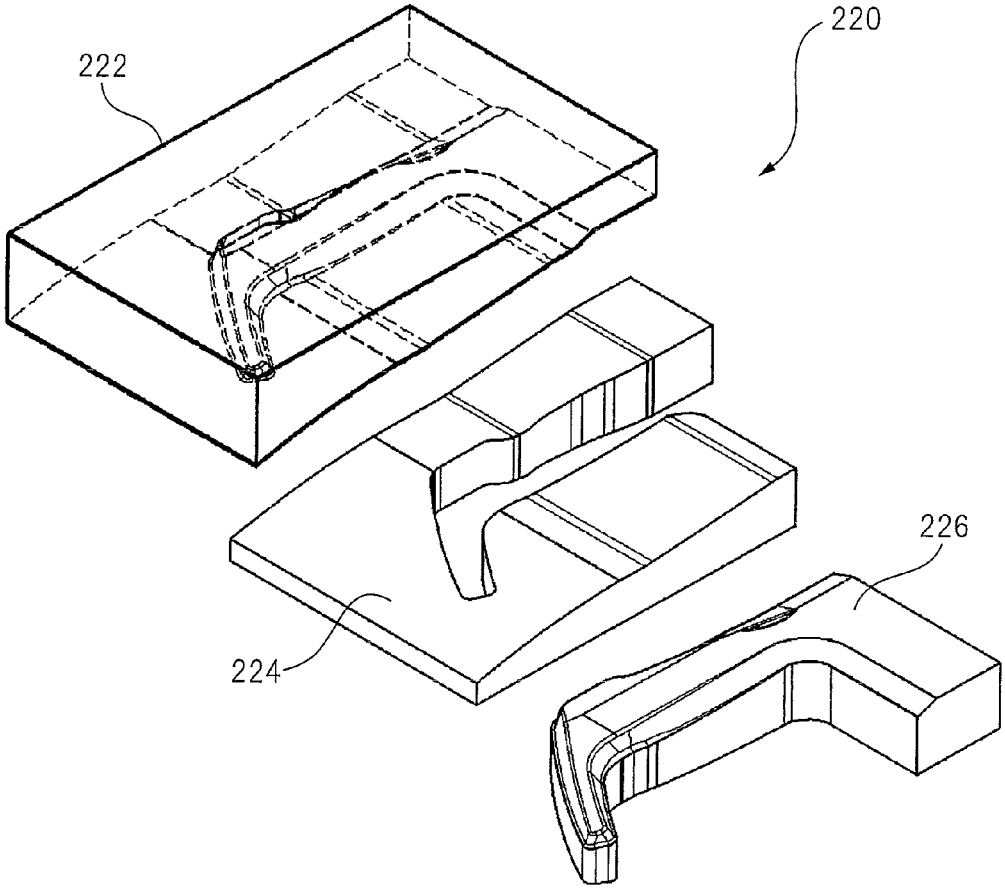
FIG. 14 is a schematic view showing the drawing die assembly used in the drawing process in the embodiment of FIG. 12.
Figure 14A:
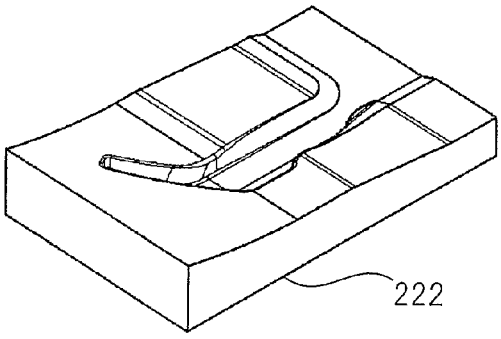
FIG. 14A is a perspective view showing lower surface of the drawing die assembly of FIG. 14.
Figure 15:
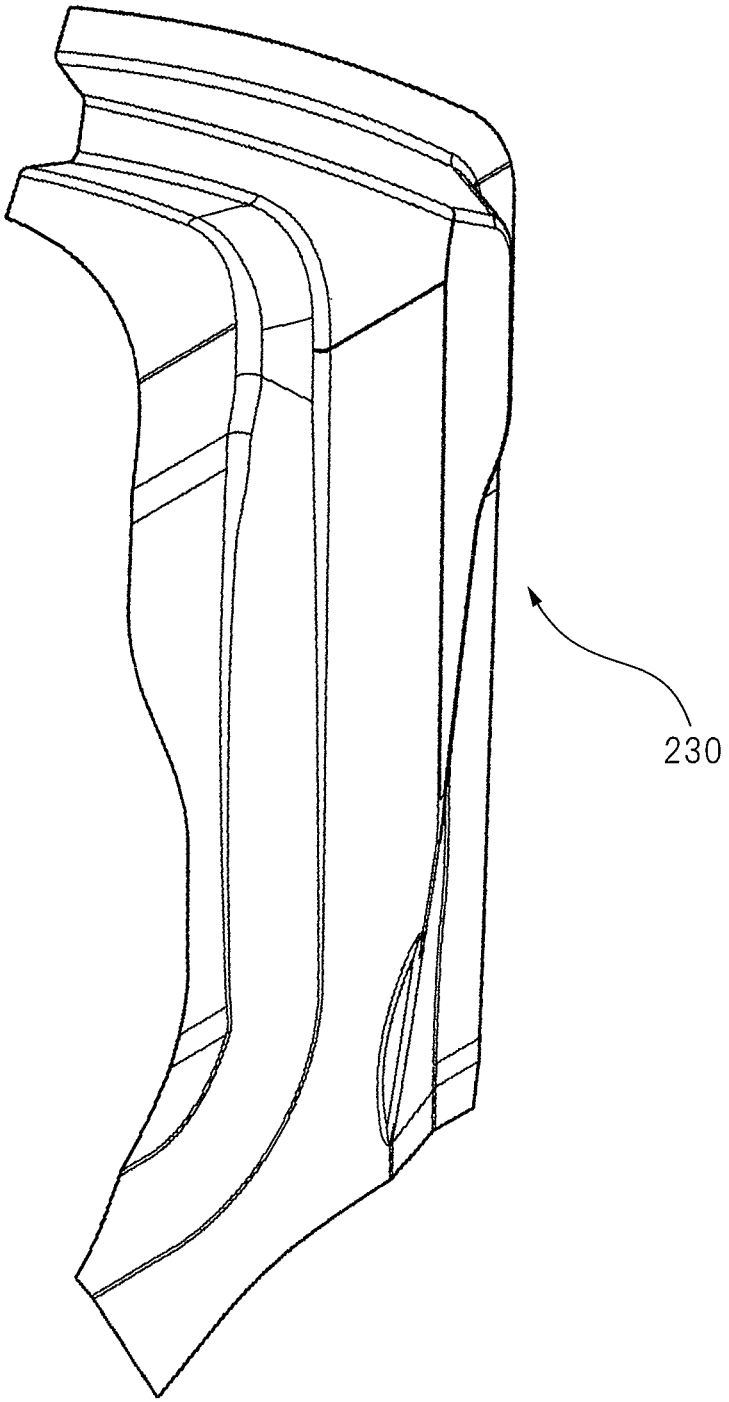
FIG. 15 is a perspective view showing an intermediate product after drawing in the embodiment of FIG. 12.

A blank 210 shown in FIG. 13 is made of a high tensile strength steel sheet having thickness of 1.8 mm, tensile strength of 980 MPa, and fracture elongation limit of 17.2%. The blank has a developed shape of the L-shaped product 200 of FIG. 12 with a margin of 5 mm. The blank 210 also has an outwardly curved protrusion 212. Referring to FIG. 14, a drawing die assembly 220 comprises a punch 222, a blank holder 224 and a drawing die 226. By drawing the blank 210 using the drawing die assembly 220, an intermediate product 230 shown in FIG. 15 is formed.

Figure 16:
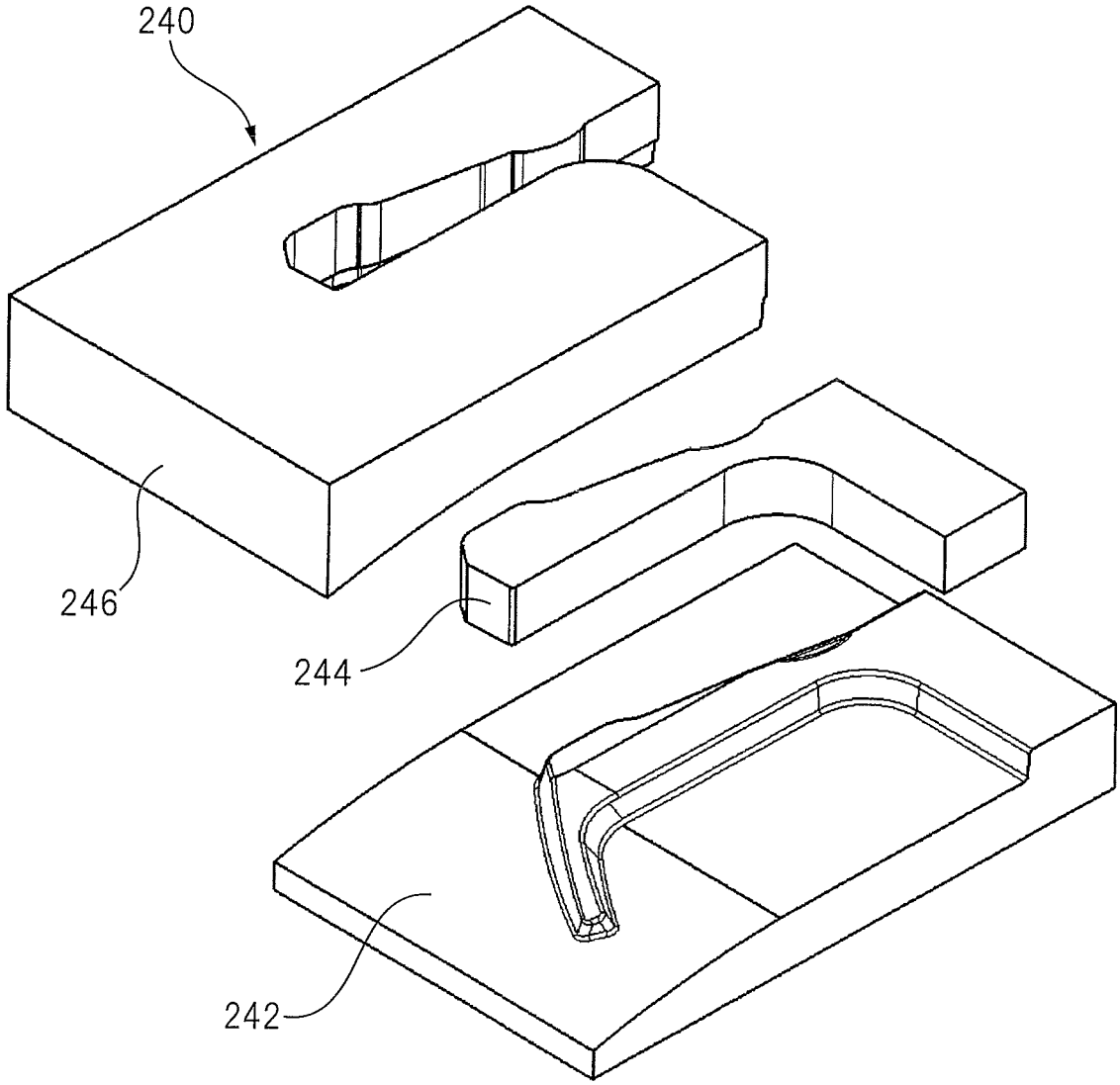
FIG. 16 is a schematic view showing the bending die assembly used in bending process in the embodiment of FIG. 12.
Figure 17A:
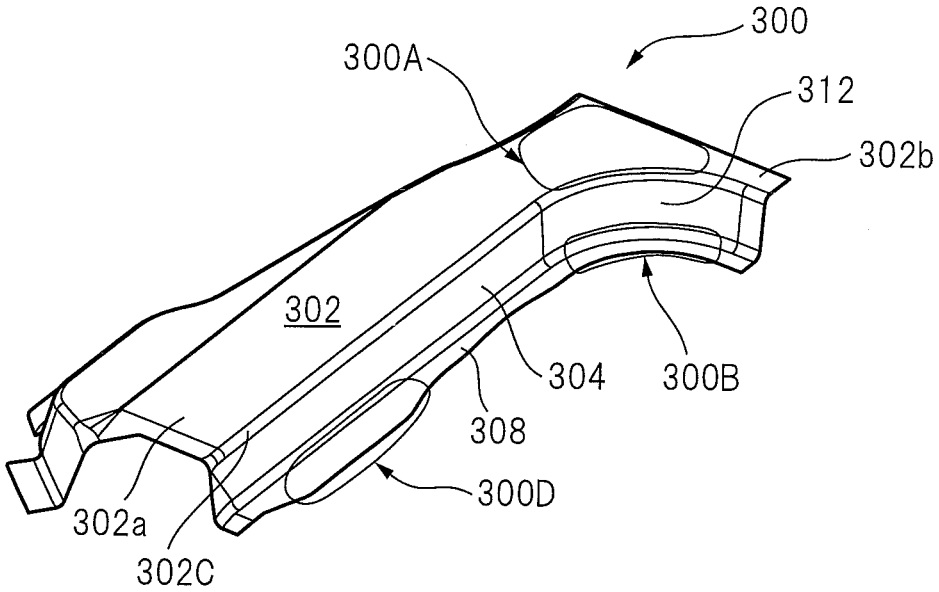
FIG. 17A is a perspective view showing an L-shaped product in another embodiment.
Figure 17B:
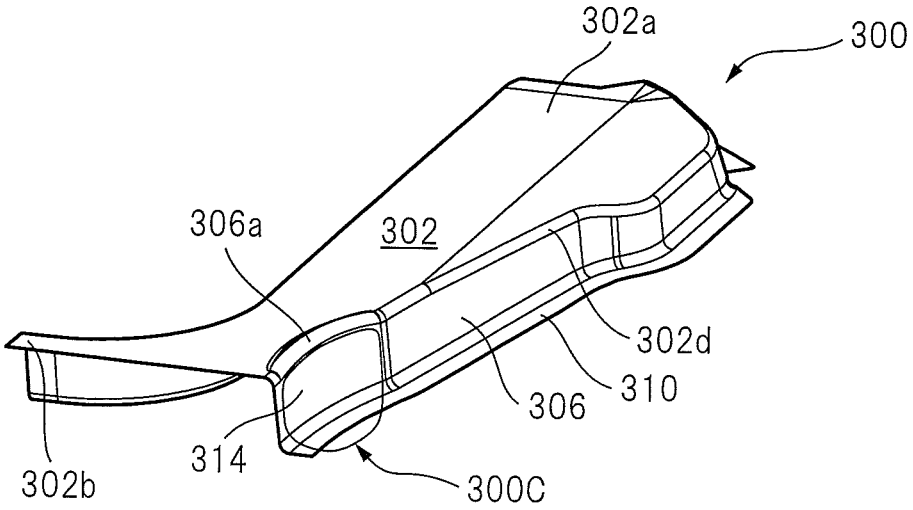
FIG. 17B is a perspective view showing the L-shaped product of FIG. 17A as viewed from an opposite side.
Figure 18:
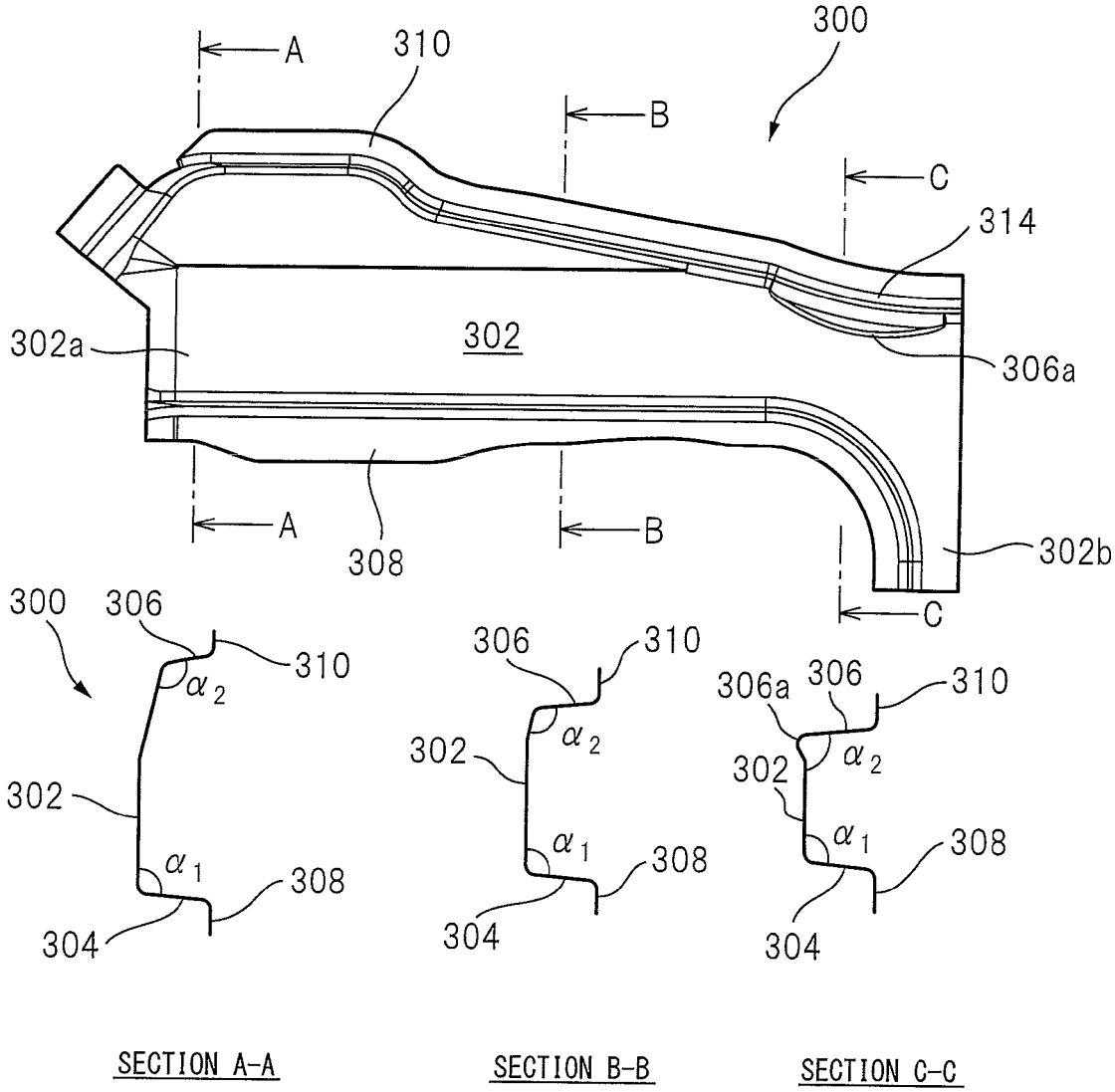
FIG. 18 is a plan view showing the L-shaped product of FIG. 17A together with sections.
Figure 19:
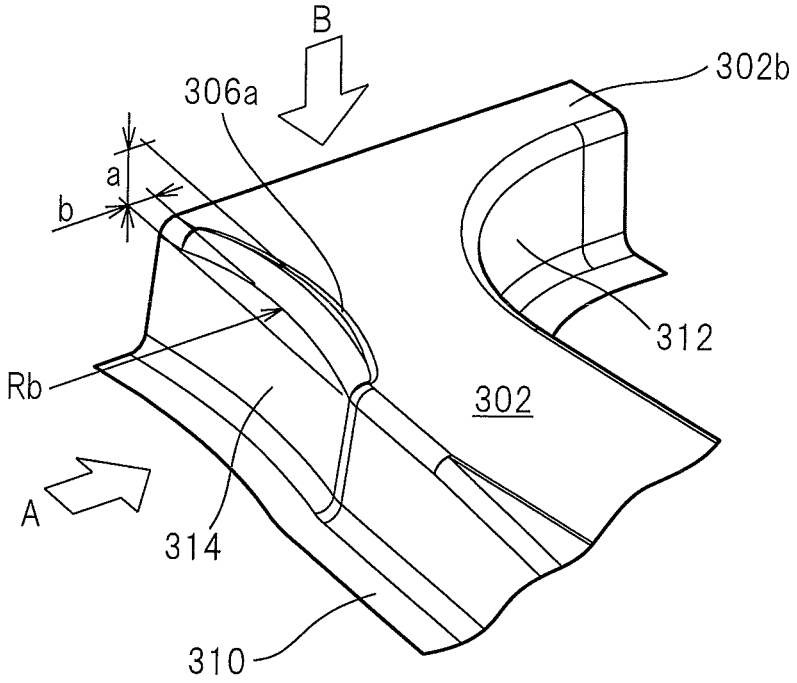
FIG. 19 is a partial enlarged perspective view showing the outside curved portion of the L-shaped product of FIG. 17A.
Figure 19A:
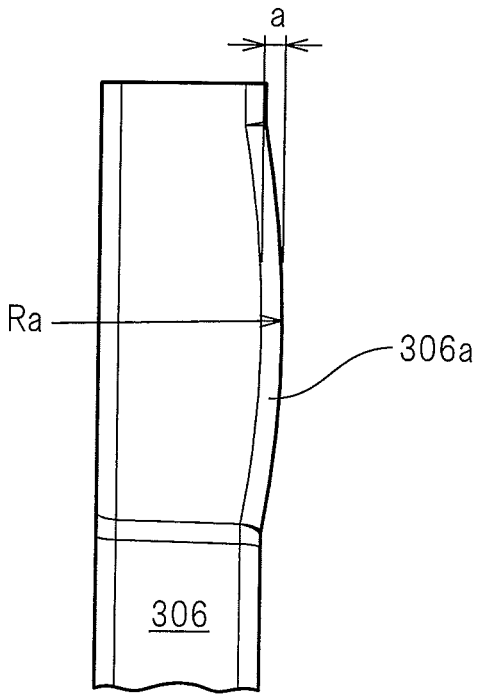
FIG. 19A is a partial enlarged side view showing the outside curved portion of the L-shaped product of FIG. 17A.
Figure 19B:
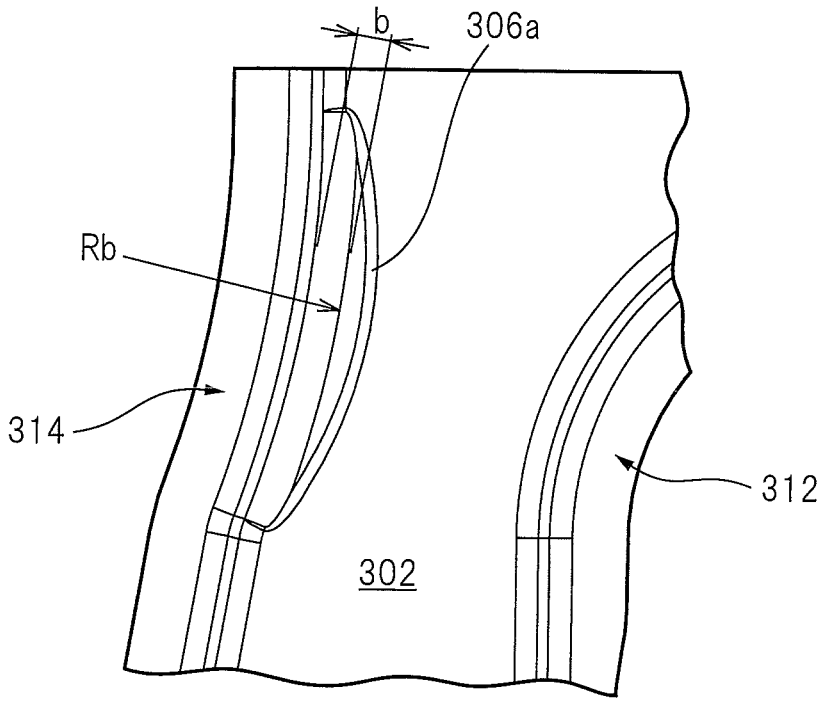
FIG. 19B is a partial enlarged plan view showing the outside curved portion of the L-shaped product of FIG. 17A.

Referring to FIG. 16, a bending die assembly 240 comprises a bending die 242, a pad 246 and a punch 248. By bending the intermediate product 230 using the bending die assembly, the L-shaped product 200 is formed. The margin was trimmed after bending. The L-shaped product 200 subjected to bending process after drawing process has a good top wall 202*a* that was formed smooth without including wrinkles or cracks.

Similarly, a good L-shaped product could be formed also in the case where an aluminum plate, having thickness of 1.8 mm, tensile strength of 296 MPa and fracture elongation limit of 24.0%, was used as the blank 210 and was subjected to stamping using the drawing die assembly 220 and the bending die assembly 240.

As shown by the Example 1 described above, according to the stamping method of the present invention, a good L-shaped product can be produced using a smaller blank compared with a blank used for conventional drawing methods. Also, an L-shaped product can be easily produced using a high tensile strength material that has been conventionally difficult to use, making it possible to reduce weight and increase strength of a monocoque body. As has been described above, the sheet metal used as the blank is not limited to a steel sheet and an aluminum plate used in the Example 1, and the present invention can be applied also to an alloy having steel and aluminum as main components as long as the sheet metal is suitable for stamping.

EXAMPLE 2

Next, referring to FIGS. 17A-24A, an experimental example is shown, in which the stamping process according to the method of producing an L-shaped product of the present invention was carried out with various parameters varied. In the experiment, it was observed whether or not wrinkles and/or cracks were generated.

In this experimental example, an L-shaped product 300 with a hat-shaped cross section to be produced by the stamping process comprises, as is the above-described embodiment, a top wall 302 substantially in the shape of L having first and second legs 302*a* and 302*b*. The L-shaped product 300 further comprises an inside wall 304 extending along an inside edge 302*c* of the top wall 302 and forming a first angle $\alpha_1$ relative to the top wall 302, and an outside wall 306 extending along an outside edge 302*d* of the top wall 302 and forming a second angle $\alpha_2$ relative to the top wall 302. Each of the inside and outside walls 304 and 306 is terminated by an inside flange 308 and an outside 310 extending substantially parallel to the top wall 302. Further, the L-shaped product 300 has an inside curved portion 312 and an outside curved portion 314 between the first and second legs 302*a* and 302*b*. The outside curved portion 314 extends substantially along a circular arc. In the outside curved portion 314, a protrusion 306*a* in the form of a circular arc, extending upwardly from the top wall, is provided on an outside edge 302*d* between the top wall 302 and the outside wall 308.

Figure 20:
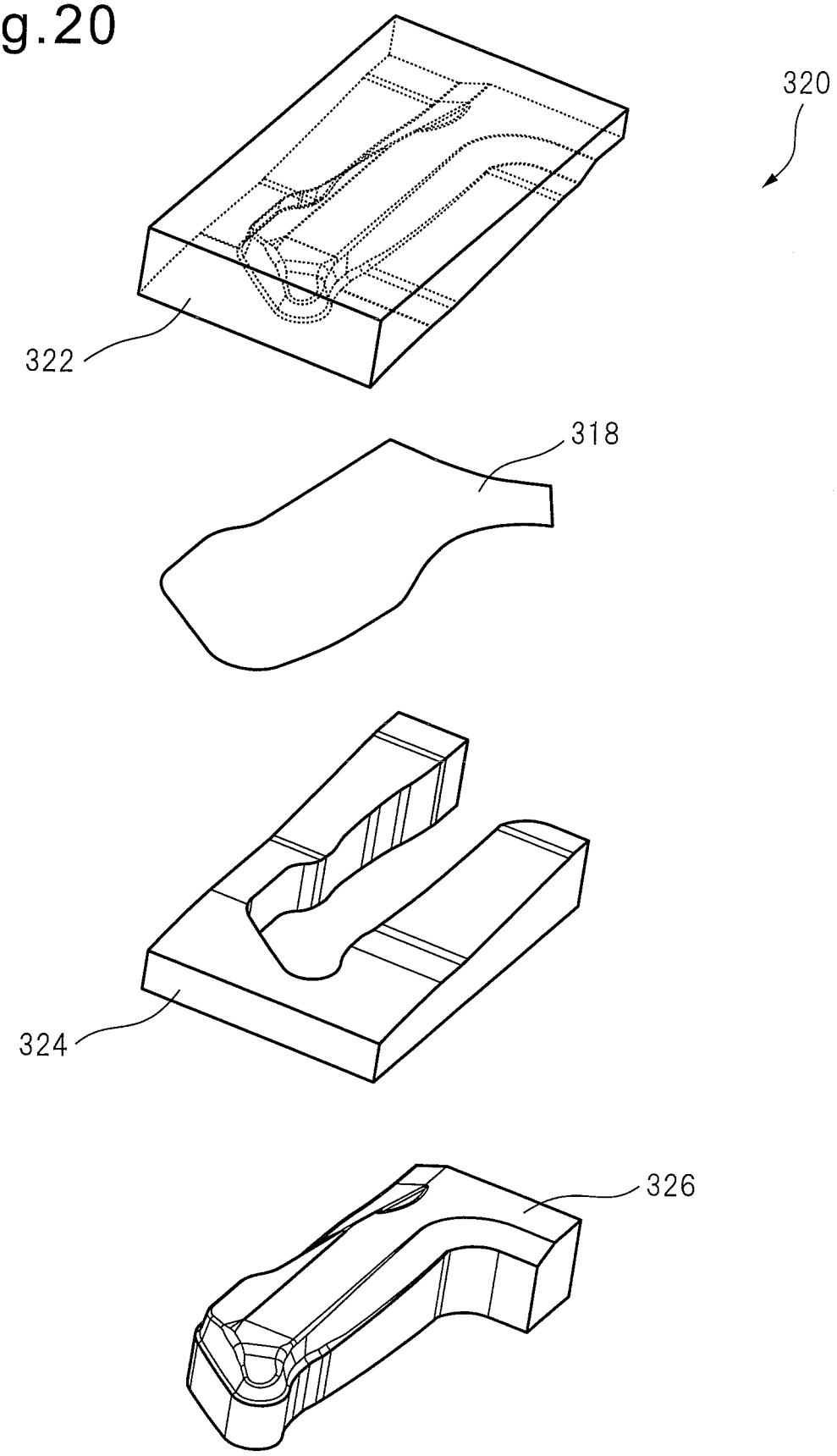
FIG. 20 is a schematic view showing the bending die assembly used in drawing process in the embodiment of FIG. 17A.
Figure 21:
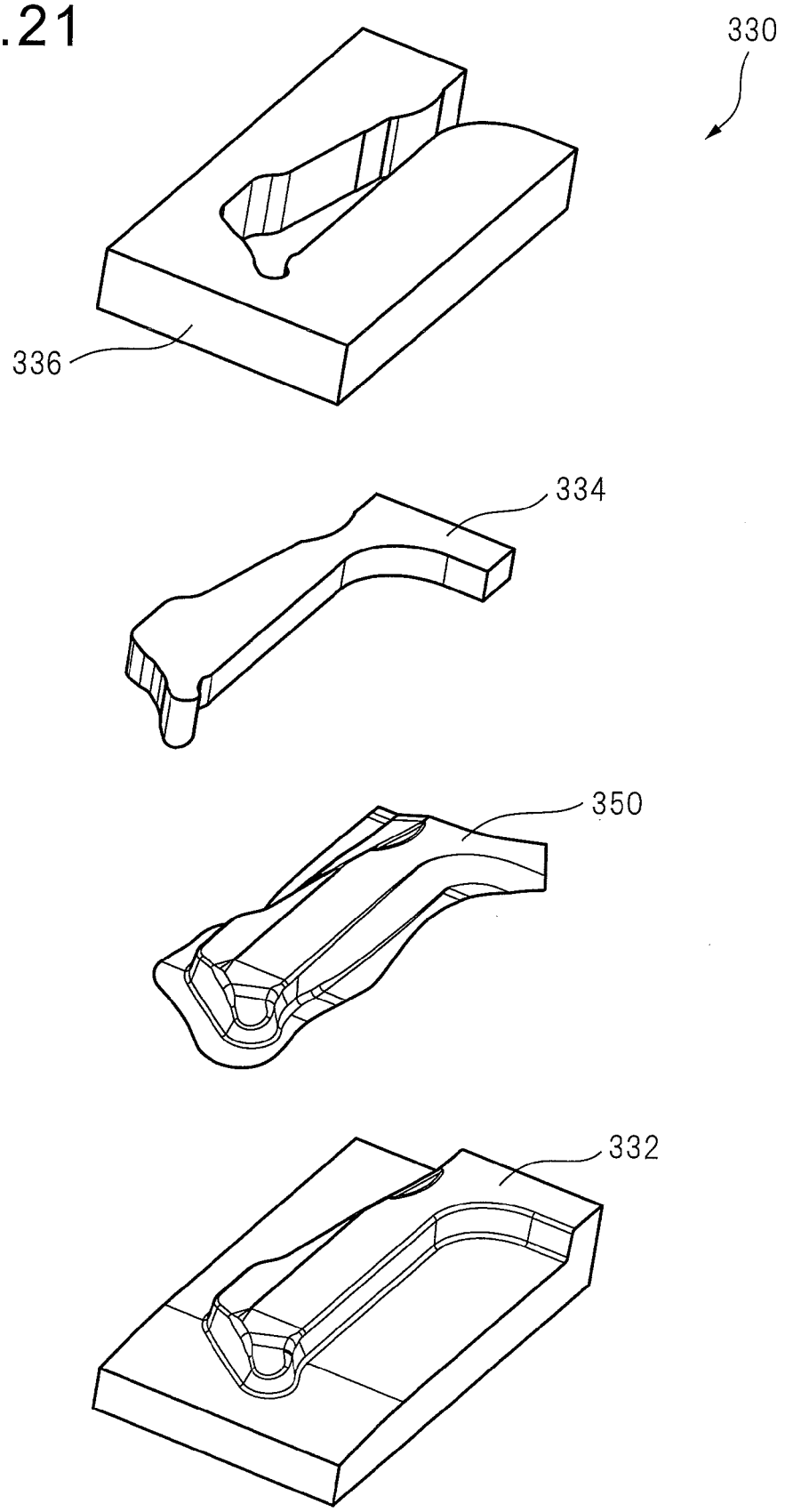
FIG. 21 is a schematic view showing the bending die assembly used in bending process in the embodiment of FIG. 17A.
Figure 22:
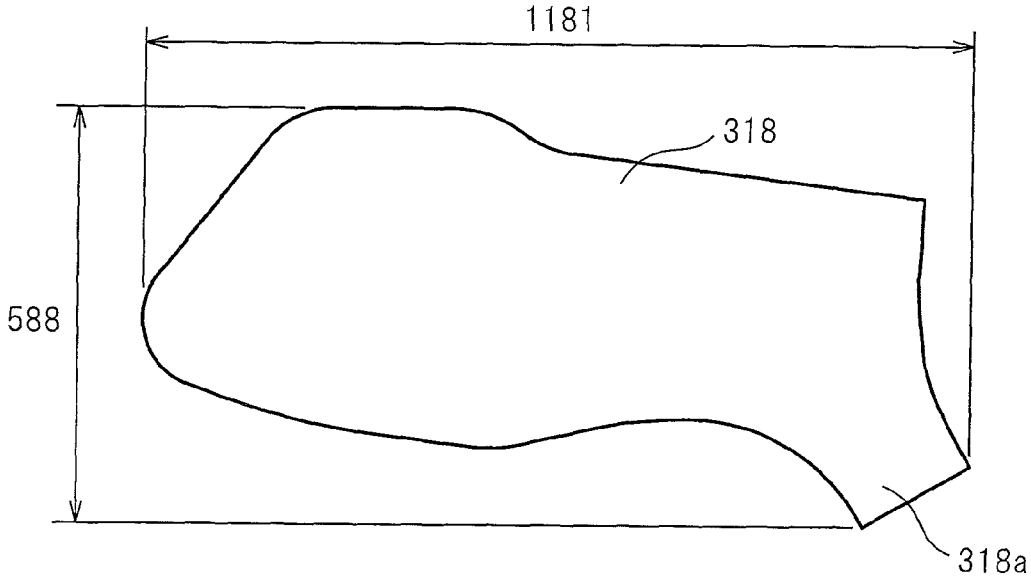
FIG. 22 is a plan view showing the blank used in the embodiment of FIG. 17A.

As shown in FIG. 20, a drawing die assembly 320, which includes a drawing die 322, a holder 324 facing the drawing die 322 and a punch 326, was provided. A blank 318 was stamped with the drawing die assembly 320 to produce an intermediate product 350. The blank 318 has an outwardly-curved protrusion 318*a* which is adapted to be formed into the second leg 302*b* of the completed L-shaped product 300.

The intermediate product 350 comprises a substantially L-shaped flat top wall 352 having first and second legs 352*a* and 352*b*, respectively corresponding to the first and second legs 302*a* and 302*b* of the top wall 302 of the L-shaped product 300. The intermediate product 350 further comprises inside and outside walls 354 and 356, respectively corresponding to the inside and outside walls 304 and 306 of the L-shaped product 300. The inside and outside walls extends along inside and outside edges 352*c* and 352*d* of the top wall 352. The intermediate product further includes inside and outside flanges 358 and 360, respectively corresponding to the inside and outside flanges 308 and 310 of the L-shaped product 300.

The intermediate product 350 includes a first region adjacent to the free end of the first leg 352*a* and an opposite second region adjacent to the second leg 352*b*. In the first region, the section of the intermediate product 350, along line A-A in FIG. 23A, has a shape substantially coincided with that of the L-shaped product 300, and a first angle $\beta_{1A}$ and a second angle $\beta_{2A}$ formed by the inside and outside walls 354 and 356 relative to the top wall 352 are substantially equal to the first angle $\alpha_1$ and a second angle $\alpha_2$ formed by the inside and outside walls 354 and 356 relative to the top wall 352 in the completed L-shaped product 10, and are in the range of 90-115°.

Figure 23:
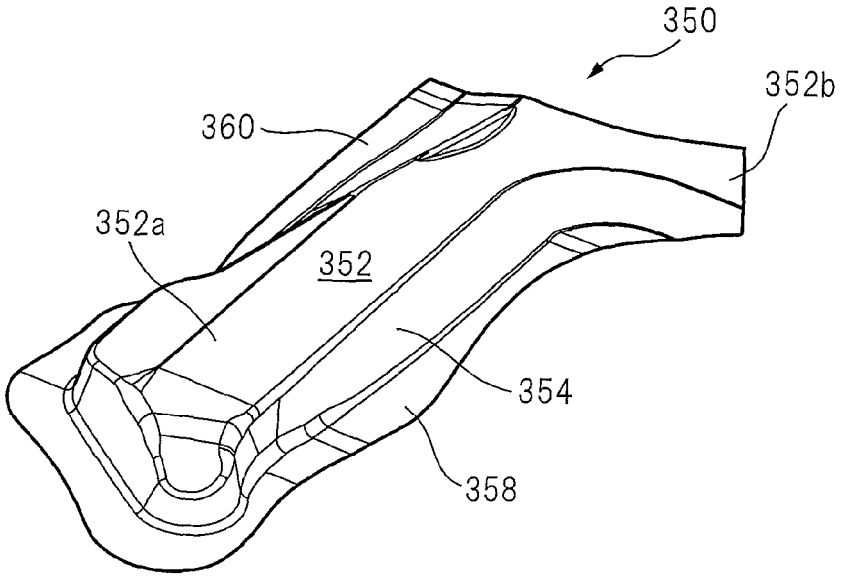
FIG. 23 is a perspective view showing an intermediate product after drawing in the embodiment of FIG. 17A.
Figure 23A:
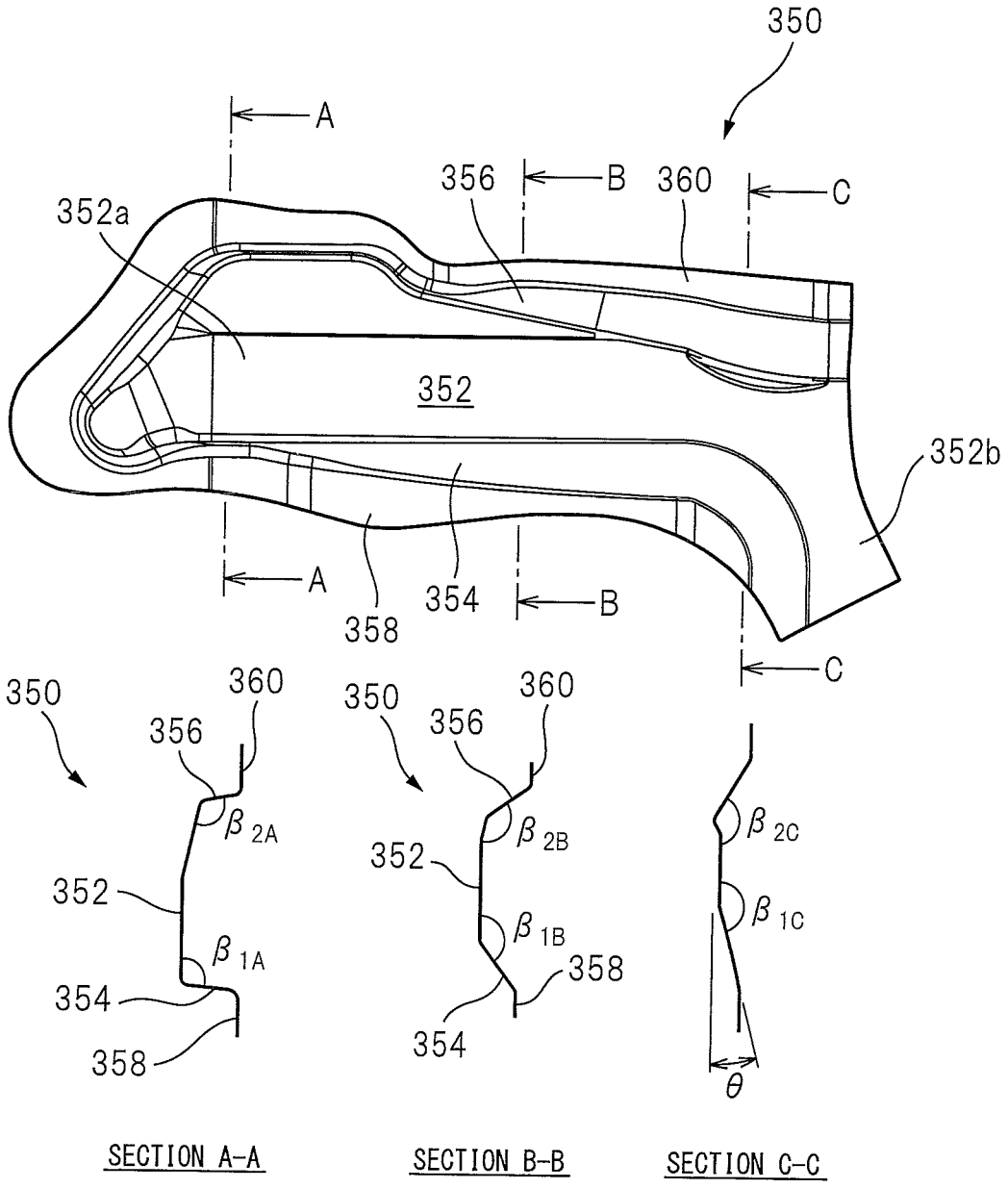
FIG. 23A is a plan view showing the intermediate product of FIG. 23 together with sections.

In the second region, as shown in sections of the intermediate product 350 along lines B-B and C-C of FIG. 23A, a first angle $\beta_{1C}$ and a second angle $\beta_{2C}$ formed by each of the inside and outside walls 354 and 356 relative to the top wall 352 are larger than the first angle $\alpha_1$ and a second angle $\alpha_2$ of the completed L-shaped product 300, and gradually increase toward the second leg 52*b*. Arrow C-C passed through the center portion of the L-shaped product 300.

Next, a bending die assembly 330 comprising an anvil 332, a pad 334 having an abutting surface 334*a* for clamping the top wall 352 of the intermediate product 350 together with the anvil 332, and a bending die 336 for stamping the intermediate product 350 to the anvil 332 was provided, and the intermediate product 350 was processed by stamping by the bending die assembly 330 to form the L-shaped product 300.

Result of implementing the present invention by varying various parameters is shown in Table 1.

TABLE 1

| | Test material | | Shape | | | | | | | Crack, wrinkle | | | |
|---|---|---|---|---|---|---|---|---|---|---|---|---|---|
| | Tensile strength (MPa) | Plate thickness (mm) | L (mm) | H (mm) | L/H | θ (° C.) | a (mm) | B (mm) | b − a (mm) | A portion wrinkle | B portion Crack | C portion wrinkle | D portion wrinkle |
| Example 1 | 980 | 1.6 | 400 | 75 | 5.33 | 20 | 7 | 7 | 0 | ○ | ○ | ○ | ○ |
| Example 2 | 980 | 1.6 | 300 | 75 | 4.00 | 20 | 7 | 7 | 0 | ○ | ○ | ○ | ○ |
| Example 3 | 980 | 1.6 | 250 | 75 | 3.33 | 20 | 7 | 7 | 0 | ○ | ○ | ○ | ○ |
| Example 4 | 980 | 1.6 | 200 | 75 | 2.67 | 20 | 7 | 7 | 0 | ○ | ○ | ○ | Δ |
| Example 5 | 980 | 1.6 | 150 | 75 | 2.00 | 20 | 7 | 7 | 0 | ○ | ○ | ○ | X |
| Example 6 | 980 | 1.6 | 100 | 75 | 1.33 | 20 | 7 | 7 | 0 | ○ | ○ | ○ | X |
| Example 7 | 980 | 1.6 | 400 | 75 | 5.33 | 25 | 7 | 7 | 0 | ○ | ○ | ○ | ○ |
| Example 8 | 980 | 1.6 | 400 | 75 | 5.33 | 30 | 7 | 7 | 0 | ○ | ○ | ○ | ○ |
| Example 9 | 980 | 1.6 | 400 | 75 | 5.33 | 35 | 7 | 7 | 0 | ○ | ○ | ○ | ○ |
| Example 10 | 980 | 1.6 | 400 | 75 | 5.33 | 40 | 7 | 7 | 0 | ○ | ○ | ○ | ○ |
| Example 11 | 980 | 1.6 | 400 | 75 | 5.33 | 45 | 7 | 7 | 0 | Δ | ○ | ○ | ○ |
| Example 12 | 980 | 1.6 | 400 | 75 | 5.33 | 50 | 7 | 7 | 0 | X | ○ | ○ | ○ |
| Example 13 | 980 | 1.6 | 400 | 75 | 5.33 | 60 | 7 | 7 | 0 | X | ○ | ○ | ○ |

TABLE 1-continued

| | Test material | | Shape | | | | | | | Crack, wrinkle | | | |
|---|---|---|---|---|---|---|---|---|---|---|---|---|---|
| | Tensile strength (MPa) | Plate thickness (mm) | L (mm) | H (mm) | L/H | θ (° C.) | a (mm) | B (mm) | b – a (mm) | A portion wrinkle | B portion Crack | C portion wrinkle | D portion wrinkle |
| Example 14 | 980 | 1.6 | 400 | 75 | 5.33 | 70 | 7 | 7 | 0 | X | X | ○ | ○ |
| Example 15 | 980 | 1.6 | 400 | 75 | 5.33 | 80 | 7 | 7 | 0 | X | X | ○ | ○ |
| Example 16 | 980 | 1.6 | 400 | 75 | 5.33 | 85 | 7 | 7 | 0 | X | X | ○ | ○ |
| Example 17 | 980 | 1.6 | 400 | 75 | 5.33 | 20 | 6 | 7 | 1 | ○ | ○ | ○ | ○ |
| Example 18 | 980 | 1.6 | 400 | 75 | 5.33 | 20 | 5 | 7 | 2 | ○ | ○ | ○ | ○ |
| Example 19 | 980 | 1.6 | 400 | 75 | 5.33 | 20 | 4 | 7 | 3 | ○ | ○ | Δ | ○ |
| Example 20 | 980 | 1.6 | 400 | 75 | 5.33 | 20 | 3 | 7 | 4 | ○ | ○ | X | ○ |
| Example 21 | 980 | 1.6 | 400 | 75 | 5.33 | 20 | 2 | 7 | 5 | ○ | ○ | X | ○ |
| Example 22 | 980 | 1.6 | 400 | 75 | 5.33 | 20 | 1 | 7 | 6 | ○ | ○ | X | ○ |
| Example 23 | 980 | 1.6 | 400 | 75 | 5.33 | 20 | 0 | 7 | 7 | ○ | ○ | X | ○ |
| Example 24 | 270 | 1.8 | 400 | 75 | 5.33 | 20 | 7 | 7 | 0 | ○ | ○ | ○ | ○ |
| Example 25 | 440 | 1.8 | 400 | 75 | 5.33 | 20 | 7 | 7 | 0 | ○ | ○ | ○ | ○ |
| Example 26 | 590 | 2.0 | 400 | 75 | 5.33 | 20 | 7 | 7 | 0 | ○ | ○ | ○ | ○ |
| Example 27 | 780 | 1.4 | 400 | 75 | 5.33 | 20 | 7 | 7 | 0 | ○ | ○ | ○ | ○ |
| Example 28 | 1180 | 1.2 | 400 | 75 | 5.33 | 20 | 7 | 7 | 0 | ○ | ○ | ○ | ○ |

crack: ○ no crack, X crack found
wrinkle: ○ no wrinkle, Δ fine wrinkle, X wrinkle found In Table 1:

L: Length of the portion in the second region where angles β1 and β2 change H: Height of the inside and outside walls 352 and 354

θ: Exterior angle formed by the inside and outside walls 354 and 352 of the intermediate product in the section along line C-C, and $\theta=180-\beta_{1c}$ a: Height of the protrusion 306*a* as seen in the direction parallel to the top wall 302 of the L-shaped product 300 b: Width of the protrusion 306*a* as seen in the direction perpendicular to the top wall 302 of the L-shaped product 300

Referring to Table 1, L/H is a parameter related to generation of wrinkles in the inside flange 308 of the L-shaped product 300. If L/H is small, in particular, smaller than 3, wrinkles occur in the portion indicated by 300D (FIG. 17A) of the inside flange 308.

θ is a parameter related to generation of wrinkles in the top wall 352 of the intermediate product 350 after drawing and to generation of cracks in the inside flange 312 adjacent to the inside curved portion 312 of the L-shaped product 300 after bending process. In particular, if θ is larger than 40°, wrinkles may occur in the portion adjacent to the second leg 352*b* in the top wall 352 of the intermediate product 350 (the portion 300A adjacent to the second leg 302*b* of the top wall 302 in the L-shaped product 300 shown in FIG. 17A). Further, if θ is larger than 70°, cracks may occur in the portion 300B (FIG. 17A) of the inside flange 312 adjacent to the inside curved portion 312 of the L-shaped product 300 after bending process.

LIST OF REFERENCE NUMERALS

10 L-shaped product
12 top wall
12*a* first leg
12*b* second leg
12*c* inside edge
12*d* outside edge
14 inside wall
16 outside wall
16*a* protrusion
18 inside flange
20 outer flange
22 inside curved portion
24 outside curved portion
26 blank
30 drawing die assembly
32 drawing die
32*a* recess
32*b* flank
34 holder
34*a* clamping surface
36 punch
36*a* outer shape
40 bending die assembly
42 anvil
42*a* outer shape
42*b* top surface
44 pad
44*a* abutting surface
46 bending die

50 intermediate product
52 top wall
52*a* first leg
52*b* second leg
52*c* inside edge
52*d* outside edge
54 inside wall
56 outside wall
58 inside flange
60 outer flange
62 inside curved portion
100 drawn panel
102 top wall
102*a* first leg
102*b* second leg
108 inside flange
200 L-shaped product
200*a* outside curved portion
202 first leg
202*a* top wall
204 second leg
206 front pillar upper part
208 wind shield side edge
210 blank
220 drawing die assembly
222 punch
224 blank holder
226 drawing die
230 intermediate product
240 bending die assembly
242 bending die
246 pad
248 punch
300 L-shaped product
302 top wall
302*a* first leg
302*b* second leg
302*c* inside edge
302*d* outside edge
304 inside wall
306 outside wall
306*a* protrusion
308 inside flange
310 outer flange
312 inside curved portion
314 outside curved portion
318 blank
320 drawing die assembly
322 drawing die
324 holder
326 punch
330 bending die assembly
332 anvil
334 pad
336 bending die
350 intermediate product
352 top wall
352 inside wall
352*a* first leg
352*b* second leg
352*c* inside edge
352*d* outside edge
354 inside wall
356 outside wall
358 inside flange
360 outer flange

The invention claimed is:

1. A method of producing an L-shaped product which includes an L-shaped flat top wall having first and second legs connected to each other so as to define inside and outside edges, an inside wall extending along and connected to the inside edge of the top wall and forming a first angle relative to the top wall, and an outside wall extending along and connected to the outside edge of the top wall and forming a second angle relative to the top wall, each of the inside and outside walls being terminated by a flange substantially parallel to the top wall, the method comprising the steps of:

providing a sheet metal material;

providing a drawing die assembly; and stamping the sheet metal material with the drawing die assembly to produce an intermediate product which includes an L-shaped flat top wall having first and second legs corresponding to the first and second legs of the L-shaped flat top wall of the completed L-shaped product, and inside and outside walls corresponding to the inside and outside walls of the completed L-shaped product, and flanges corresponding to the flanges of the completed L-shaped product;

wherein the intermediate product includes a first region adjacent to a free end of the first leg and an opposite second region adjacent to the second leg, wherein, in the first region, the angle between each of the inside and outside walls relative to the top wall of the intermediate product substantially coincides with the first and second angles of the completed L-shaped product, and wherein, in the second region, the angle between each of the inside and outside walls relative to the top wall gradually increases toward the second leg;

the method further comprising the steps of:

providing a bending die assembly;

stamping the intermediate product by the bending die assembly to produce the completed L-shaped product.

2. The method of producing an L-shaped product according to claim 1, wherein the drawing die assembly comprises a recess having a shape corresponding to the top, inside and outside walls of the intermediate product, a drawing die having a flank extending along the peripheral edge of the recess, a holder having a clamping surface for clamping the sheet metal material in cooperation with the flank of the drawing die, and a punch provided so as to be able to press the sheet metal material into the recess of the drawing die.

3. The method of producing an L-shaped product according to claim 2, wherein the clamping surface of the holder has a shape which does not clamp a portion of the blank opposite to the free end of the first leg and corresponding to an edge adjacent the second leg of the intermediate product.

4. The method of producing an L-shaped product according to claim 3, wherein in a region adjacent to the second leg and in the vicinity of an edge opposite to the free end of the first leg, the inside wall of the intermediate product extends substantially in the same plane as the top wall.

5. The method of producing an L-shaped product according to claim 1, wherein the bending die assembly comprises an anvil having a shape corresponding to the shape of the completed L-shaped product, a pad having an abutting surface for clamping the top wall of the intermediate product in cooperation with the anvil, and a bending die for pressing the intermediate product to the anvil.

6. The method of producing an L-shaped product according to claim 5, wherein the anvil includes a flat top surface facing to the abutting surface of the pad, the L-shaped top wall of the intermediate product being positioned between the top surface of the anvil and the abutting surface of the pad, and wherein, during the stamping process by the bending die assembly, the inside wall and the inside flange and the outside wall and the outer flange of the L-shaped product are bent by the bending die assembly under the condition where the top wall of the intermediate product is clamped by the top surface of the anvil and the abutting surface of the pad.

7. The method of producing an L-shaped product according to claim 6, wherein the completed L-shaped product includes an outside curved portion recessed into a circular arc shape along the outside edge between the first and second legs, and wherein the anvil has a ridge portion protruding from the top surface, and the pad includes a recess for receiving the ridge portion of the anvil, so that a rib projecting outward is formed on the top surface along the outside curved portion recessed in circular arc shape of the completed L-shaped product.

8. The method of producing an L-shaped product according to any one of claims 1-7, wherein the L-shaped product has an inside curved portion curved in circular arc shape between the first and second legs along the inside wall, and wherein the flange of the inside wall has width of 25-100 mm in the range of 100 mm from the center of the inside curved portion toward the frontend of the first leg.

9. The method of producing an L-shaped product according to any one of claims 1-7, wherein the inside curved portion of the inside wall has a radius of curvature of 10-300 mm.

10. The method of producing an L-shaped product according to any one of claims 1-7, wherein the outside curved portion of the outside wall has a radius of curvature of 200-1000 mm.

11. The method of producing an L-shaped product according to any one of claims 1-7, wherein the sheet metal material has tensile strength of 400-1600 MPa.

* * * * *

UNITED STATES PATENT AND TRADEMARK OFFICE

CERTIFICATE OF CORRECTION

PATENT NO. : 9,211,579 B2
APPLICATION NO. : 13/989095
DATED : December 15, 2015
INVENTOR(S) : Tanaka et al.

It is certified that error appears in the above-identified patent and that said Letters Patent is hereby corrected as shown below:

In the specification

Columns 5, line 49, change "$\beta_{2A}$ and $\beta_{2B}$" to -- "$\beta_{1A}$ and $\beta_{1B}$" --; and Columns 6, line 44, change "product (portion" to -- "product 50 (portion" --.

Signed and Sealed this
Twenty-sixth Day of July, 2016

Michelle K. Lee

Michelle K. Lee
*Director of the United States Patent and Trademark Office*